US010002621B2

(12) United States Patent
Disch et al.

(10) Patent No.: US 10,002,621 B2
(45) Date of Patent: Jun. 19, 2018

(54) APPARATUS AND METHOD FOR DECODING AN ENCODED AUDIO SIGNAL USING A CROSS-OVER FILTER AROUND A TRANSITION FREQUENCY

(71) Applicant: Fraunhofer-Gesellschaft zur Foerderung der angewandten Forschung e.V., Munich (DE)

(72) Inventors: Sascha Disch, Fuerth (DE); Ralf Geiger, Erlangen (DE); Christian Helmrich, Erlangen (DE); Frederik Nagel, Heroldsberg (DE); Christian Neukam, Kalchreuth (DE); Konstantin Schmidt, Nuremberg (DE); Michael Fischer, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days. days.

(21) Appl. No.: 15/002,343

(22) Filed: Jan. 20, 2016

(65) Prior Publication Data

US 2016/0140979 A1 May 19, 2016

Related U.S. Application Data

(63) Continuation of application No. PCT/EP2014/065112, filed on Jul. 15, 2014.

(30) Foreign Application Priority Data

Jul. 22, 2013 (EP) ..... 13177346
Jul. 22, 2013 (EP) ..... 13177348
(Continued)

(51) Int. Cl.
*G10L 21/0388* (2013.01)
*G10L 19/025* (2013.01)
(Continued)

(52) U.S. Cl.
CPC ..... *G10L 21/0388* (2013.01); *G10L 19/022* (2013.01); *G10L 19/0204* (2013.01);
(Continued)

(58) Field of Classification Search
CPC ..... G10L 21/0388
(Continued)

(56) References Cited

U.S. PATENT DOCUMENTS 4,757,517 A 7/1988 Yatsuzuka
5,502,713 A 3/1996 Lagerqvist et al.
(Continued)

FOREIGN PATENT DOCUMENTS

CN 1677491 A 10/2005
CN 1864436 A 11/2006
(Continued)

OTHER PUBLICATIONS

Brinker, A. et al., "An overview of the coding standard MPEG-4 audio amendments 1 and 2: HE-AAC, SSC, and HE-AAC v2", EURASIP Journal on Audio, Speech, and Music Processing, 2009, Feb. 24, 2009, 24 pages.
(Continued)

*Primary Examiner* — Shaun Roberts
(74) *Attorney, Agent, or Firm* — Michael A. Glenn; Perkins Coie LLP

(57) ABSTRACT

Apparatus for decoding an encoded audio signal including an encoded core signal, including: a core decoder for decoding the encoded core signal to obtain a decoded core signal; a tile generator for generating one or more spectral tiles having frequencies not included in the decoded core signal using a spectral portion of the decoded core signal; and a cross-over filter for spectrally cross-over filtering the decoded core signal and a first frequency tile having frequencies extending from a gap filling frequency to an upper
(Continued)

border frequency or for spectrally cross-over filtering a first frequency tile and a second frequency tile.

15 Claims, 23 Drawing Sheets

(30) Foreign Application Priority Data

Jul. 22, 2013 (EP) ..... 13177350
Jul. 22, 2013 (EP) ..... 13177353
Oct. 18, 2013 (EP) ..... 13189389

(51) Int. Cl.
*G10L 19/03* (2013.01)
*G10L 19/02* (2013.01)
*G10L 19/022* (2013.01)
*G10L 19/032* (2013.01)
*G10L 19/06* (2013.01)
*G10L 25/06* (2013.01)
*H04S 1/00* (2006.01)

(52) U.S. Cl.
CPC ..... *G10L 19/025* (2013.01); *G10L 19/0208* (2013.01); *G10L 19/0212* (2013.01); *G10L 19/03* (2013.01); *G10L 19/032* (2013.01); *G10L 19/06* (2013.01); *G10L 25/06* (2013.01); *H04S 1/007* (2013.01); *G10L 19/02* (2013.01)

(58) Field of Classification Search
USPC ..... 704/200.1, 500
See application file for complete search history.

(56) References Cited

U.S. PATENT DOCUMENTS 5,717,821 A 2/1998 Tsutsui et al.
5,926,788 A 7/1999 Nishiguchi
6,041,295 A 3/2000 Hinderks
6,104,321 A 8/2000 Akagiri
6,289,308 B1 9/2001 Lokhoff
6,680,972 B1 1/2004 Liljeryd et al.
6,708,145 B1 3/2004 Liljeryd et al.
6,826,526 B1 11/2004 Norimatsu et al.
7,246,065 B2 7/2007 Tanaka et al.
7,328,161 B2 2/2008 Oh
7,447,317 B2 11/2008 Herre et al.
7,460,990 B2 12/2008 Mehrotra et al.
7,483,758 B2 1/2009 Liljeryd et al.
7,502,743 B2 3/2009 Thumpudi et al.
7,739,119 B2 6/2010 Venkatesha Rao et al.
7,756,713 B2 7/2010 Chong et al.
7,761,303 B2 7/2010 Pang et al.
7,801,735 B2 9/2010 Thumpudi et al.
7,917,369 B2 3/2011 Chen et al.
7,945,449 B2 5/2011 Vinton et al.
8,112,284 B2 2/2012 Kjörling et al.
8,135,047 B2 3/2012 Rajendran et al.
8,412,365 B2 4/2013 Liljeryd et al.
8,473,301 B2 6/2013 Chen et al.
8,655,670 B2 2/2014 Purnhagen et al.
8,892,448 B2 11/2014 Vos et al.
9,015,041 B2 4/2015 Disch et al.
2003/0014136 A1 1/2003 Wang et al.
2003/0074191 A1 4/2003 Byrnes et al.
2003/0220800 A1 11/2003 Budnikov et al.
2004/0008615 A1 1/2004 Oh
2004/0024588 A1 2/2004 Watson et al.
2004/0028244 A1 2/2004 Tsushima et al.
2004/0054525 A1 3/2004 Sekiguchi et al.
2005/0074127 A1 4/2005 Herre et al.
2005/0165611 A1 7/2005 Mehrotra et al.
2005/0216262 A1 9/2005 Fejzo
2005/0278171 A1 12/2005 Suppappola et al.
2006/0006103 A1 1/2006 Sirota et al.
2006/0031075 A1 2/2006 Oh et al.
2006/0095269 A1 5/2006 Smith et al.
2006/0122828 A1 6/2006 Lee et al.
2006/0210180 A1 9/2006 Geiger et al.
2006/0265210 A1* 11/2006 Ramakrishnan ..... G10L 21/038 704/205
2006/0282263 A1 12/2006 Vos et al.
2007/0100607 A1 5/2007 Villemoes
2007/0147518 A1 6/2007 Bessette et al.
2007/0196022 A1 8/2007 Geiger et al.
2007/0282603 A1 12/2007 Bessette
2008/0027717 A1 1/2008 Rajendran et al.
2008/0040103 A1 2/2008 Vinton et al.
2008/0208600 A1 8/2008 Pang et al.
2008/0262835 A1 10/2008 Oshikiri et al.
2008/0262853 A1 10/2008 Jung et al.
2008/0312758 A1 12/2008 Koishida et al.
2009/0006103 A1 1/2009 Koishida et al.
2009/0132261 A1 5/2009 Kjorling et al.
2009/0144055 A1 6/2009 Davidson et al.
2009/0144062 A1 6/2009 Ramabadran et al.
2009/0180531 A1 7/2009 Wein et al.
2009/0192789 A1 7/2009 Lee et al.
2009/0216527 A1 8/2009 Oshikiri et al.
2009/0226010 A1 9/2009 Schnell et al.
2009/0234644 A1 9/2009 Reznik et al.
2010/0063808 A1 3/2010 Gao et al.
2010/0070270 A1* 3/2010 Gao ..... G10H 1/0041 704/207
2010/0177903 A1 7/2010 Vinton et al.
2010/0211399 A1 8/2010 Liljeryd et al.
2010/0241437 A1 9/2010 Taleb et al.
2010/0286981 A1 11/2010 Krini et al.
2011/0046945 A1 2/2011 Li et al.
2011/0093276 A1 4/2011 Ramo et al.
2011/0106545 A1 5/2011 Disch et al.
2011/0125505 A1 5/2011 Vaillancourt et al.
2011/0173006 A1 7/2011 Nagel et al.
2011/0173007 A1 7/2011 Multrus et al.
2011/0202352 A1* 8/2011 Neuendorf ..... G10L 19/0208 704/500
2011/0235809 A1 9/2011 Schuijers et al.
2011/0238425 A1 9/2011 Neuendorf et al.
2011/0264454 A1 10/2011 Ullberg et al.
2011/0264457 A1 10/2011 Oshikiri et al.
2011/0295598 A1 12/2011 Yang et al.
2011/0320212 A1 12/2011 Tsujino et al.
2012/0002818 A1 1/2012 Heiko et al.
2012/0029923 A1 2/2012 Rajendran et al.
2012/0136670 A1 5/2012 Ishikawa et al.
2012/0158409 A1 6/2012 Nagel et al.
2012/0296641 A1 11/2012 Rajendran et al.
2013/0051571 A1 2/2013 Nagel et al.
2013/0090933 A1 4/2013 Villemoes et al.
2013/0121411 A1 5/2013 Robillard et al.
2013/0156112 A1 6/2013 Suzuki et al.
2013/0185085 A1 7/2013 Tsujino et al.
2013/0282383 A1 10/2013 Hedelin et al.
2014/0088973 A1* 3/2014 Gibbs ..... G10L 19/20 704/500
2014/0149126 A1 5/2014 Soulodre
2014/0229186 A1 8/2014 Mehrotra et al.
2016/0210977 A1 7/2016 Ghido et al.
2017/0116999 A1 4/2017 Gao
2017/0133023 A1 5/2017 Disch

FOREIGN PATENT DOCUMENTS

CN 101067931 A 11/2007
CN 101083076 A 12/2007
CN 101238510 A 8/2008
CN 101325059 A 12/2008
CN 101609680 A 12/2009
CN 102089758 A 6/2011
EP 0751493 A2 2/1997
EP 1734511 A2 12/2006

(56) References Cited

FOREIGN PATENT DOCUMENTS

| | | | |
|---|---|---|---|
| EP | 1446797 | B1 | 5/2007 |
| EP | 2077551 | B1 | 3/2011 |
| JP | H07336231 | A | 12/1995 |
| JP | 200250967 | A | 2/2002 |
| JP | 2003108197 | A | 4/2003 |
| JP | 2003140692 | A | 5/2003 |
| JP | 2004046179 | A | 2/2004 |
| JP | 2006323037 | A | 11/2006 |
| JP | 3898218 | B2 | 3/2007 |
| JP | 3943127 | B2 | 7/2007 |
| JP | 2007532934 | A | 11/2007 |
| JP | 2010538318 | A | 12/2010 |
| JP | 2012027498 | A | 2/2012 |
| JP | 2013125187 | A | 6/2013 |
| JP | 2013521538 | A | 6/2013 |
| JP | 2013524281 | A | 6/2013 |
| KR | 1020070118173 | A | 12/2007 |
| KR | 20130025963 | A | 3/2013 |
| RU | 2323469 | C2 | 4/2008 |
| RU | 2325708 | C2 | 5/2008 |
| RU | 2388068 | C2 | 4/2010 |
| RU | 2422922 | C1 | 6/2011 |
| RU | 2428747 | C2 | 9/2011 |
| RU | 2459282 | C2 | 8/2012 |
| RU | 2470385 | C2 | 12/2012 |
| RU | 2477532 | C2 | 3/2013 |
| RU | 2481650 | C2 | 5/2013 |
| RU | 2482554 | C1 | 5/2013 |
| RU | 2487427 | C2 | 7/2013 |
| TW | 412719 | B | 11/2000 |
| TW | 200537436 | A | 11/2005 |
| TW | 200939206 | A | 9/2009 |
| TW | 201007696 | A | 2/2010 |
| TW | 201009812 | A | 3/2010 |
| TW | 201034001 | A | 9/2010 |
| TW | 201205558 | A | 2/2012 |
| TW | 201316327 | A | 4/2013 |
| TW | 201333933 | A | 8/2013 |
| WO | 2005104094 | A1 | 11/2005 |
| WO | 2005109240 | A1 | 11/2005 |
| WO | 2006107840 | A1 | 10/2006 |
| WO | 2008084427 | A2 | 7/2008 |
| WO | 2010070770 | A1 | 6/2010 |
| WO | 2010114123 | A1 | 10/2010 |
| WO | 2010136459 | A1 | 12/2010 |
| WO | 2011047887 | A1 | 4/2011 |
| WO | 2011110499 | A1 | 9/2011 |
| WO | 2012110482 | A2 | 8/2012 |
| WO | 2013061530 | A1 | 5/2013 |
| WO | 2013147666 | A1 | 10/2013 |
| WO | 2013147668 | A1 | 10/2013 |
| WO | 2015010949 | A1 | 1/2015 |

OTHER PUBLICATIONS

"Information technology—MPEG audio technologies—Part 3: Unified speech and audio coding", ISO/IEC FDIS 23003-3:2011(E); ISO/IEC JTC 1/SC 29/WG 11; STD Version 2.1c2, Sep. 20, 2011, 291 pages.

Annadana, R et al., "New Results in Low Bit Rate Speech Coding and Bandwidth Extension", Audio Engineering Society Convention 121, Audio Engineering Society Convention Paper 6876, Oct. 5-8, 2006, pp. 1-6.

Bosi, M et al., "ISO/IEC MPEG-2 Advanced Audio Coding", J. Audio Eng. Soc., vol. 45, No. 10, Oct. 1997, pp. 789-814.

Daudet, L et al., "MDCT analysis of sinusoids: exact results and applications to coding artifacts reduction", IEEE Transactions on Speech and Audio Processing, IEEE, vol. 12, No. 3, May 2004, pp. 302-312.

Dietz, M et al., "Spectral Band Replication, a Novel Approach in Audio Coding", Engineering Society Convention 121, Audio Engineering Society Paper 5553, May 10-13, 2002, pp. 1-8.

Ekstrand, P , "Bandwidth Extension of Audio Signals by Spectral Band Replication", Proc.1st IEEE Benelux Workshop on Model based Processing and Coding of Audio (MPCA-2002), Nov. 15, 2002, pp. 53-58.

Ferreira, A.J.S et al., "Accurate Spectral Replacement", Audio Engineering Society Convention, 118, Audio Engineering Society Convention Paper No. 6383, May 28-31, 2005, pp. 1-11.

Geiser, B et al., "Bandwidth Extension for Hierarchical Speech and Audio Coding in ITU-T Rec. G.729.1", IEEE Transactions on Audio, Speech and Language Processing, IEEE Service Center, vol. 15, No. 8, Nov. 2007, pp. 2496-2509.

Herre, J et al., "Extending the MPEG-4 AAC Codec by Perceptual Noise Substitution", Audio Engineering Society Convention 104, Audio Engineering Society Preprint,, May 16-19, 1998, pp. 1-14.

Herre, J , "Temporal Noise Shaping, Quantization and Coding Methods in Perceptual Auidio Coding: A Tutorial Introduction", Audio Engineering Society Conference: 17th International Conference: High-Quality Audio Coding, Audio Engineering Society, Aug. 1, 1999, pp. 312-325.

ISO/IEC 13818-3:1998(E), "Information Technology—Generic Coding of Moving Pictures and Associated Audio, Part 3: Audio", Second Edition, ISO/IEC, Apr. 15, 1998, 132 pages.

ISO/IEC 14496-3:2001, , "Information Technology—Coding of audio-visual objects—Part 3: Audio, Amendment 1: Bandwidth Extension", ISO/IEC JTC1/SC29/WG11/N5570, ISO/IEC 14496-3:2001/FDAM 1:2003(E), Mar. 2003, 127 pages.

ISO/IEC FDIS 23003-3:2011(E), , "Information Technology—MPEG audio technologies—Part 3: Unified speech and audio coding, Final Draft", ISO/IEC, 2010, 286 pages.

McAulay, R et al., "Speech Analysis/ Synthesis Based on a Sinusoidal Representation", IEEE Transactions on Acoustics, Speech and Signal Processing, vol. ASSP-34, No. 4, Aug. 1986, pp. 744-754.

Mehrotra, Sanjeev et al., "Hybrid low bitrate audio coding using adaptive gain shape vector quantization", Multimedia Signal Processing, 2008 IEEE 10th Workshop on, IEEE, Piscataway, NJ, USA, XP031356759 ISBN: 978-1-4344-3394-4, Oct. 8, 2008, pp. 927-932.

Nagel, F et al., "A Continuous Modulated Single Sideband Bandwidth Extension", ICASSP International Conference on Acoustics, Speech and Signal Processing, Apr. 2010, pp. 357-360.

Nagel, F et al., "A Harmonic Bandwidth Extension Method for Audio Codecs", International Conference on Acoustics, Speech and Signal Processing, XP002527507, Apr. 19, 2009, pp. 145-148.

Neuendorf, M et al., "MPEG Unified Speech and Audio Coding—The ISO/MPEG Standard for High-Efficiency Audio Coding of all Content Types", Audio Engineering Society Convention Paper 8654, Presented at the 132nd Convention, Apr. 26-29, 2012, pp. 1-22.

Purnhagen, H et al., "HILN-the MPEG-4 parametric audio coding tools", Proceedings ISCAS 2000 Geneva, The 2000 IEEE International Symposium on Circuits and Systems, May 28-31, 2000, pp. 201-204.

Sinha, D. et al., "A Novel Integrated Audio Bandwidth Extension Toolkit (ABET)", Audio Engineering Society Convention, Paris, France, May 2006.

Smith, J.O. et al., "PARSHL: An analysis/synthesis program for non-harmonic sounds based on a sinusoidal representation", Proceedings of the International Computer Music Conference, 1987.

Zernicki, T et al., "Audio bandwidth extension by frequency scaling of sinusoidal partials", Audio Engineering Society Convention, San Francisco, USA, Oct. 2-5, 2008.

* cited by examiner

| SCB1 | SCB2 | SCB3 | SCB4 | SCB5 | SCB6 | SCB7 |
|---|---|---|---|---|---|---|
| SF1 | SF2 | SF3 | SF4 | SF5 | SF6 | SF7 |
| | | | $E_1$ | $E_2$ | $E_3$ | $E_4$ |
| | $NF_2$ | | | | | |

308 310 312

FIG 3B (QUANTIZER PROCESSOR)

(OTHER SPECTRAL PORTIONS)

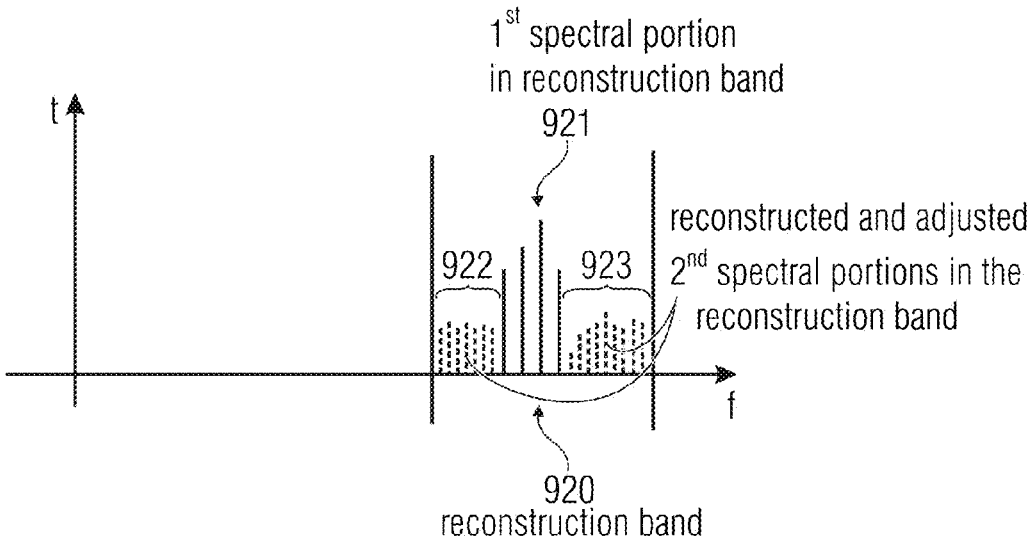

e.g.

- surviving energy: 5 units
- energy value for reconstr. band: 10 units (covers 1st and 2nd spectral portions in the reconstruction band)
- energy of source range data or raw target range data: 8 units
- missing energy: 5 units
- gain factor: $g := \sqrt{\frac{mE_k}{pE_k}} = 0.79$ → only spectral values for the 2nd spectral portions are adjusted → 1st spectral portion is not influenced by the envelope adjustment

FIG 9C

Spectrogram of a transient after applying BWE.
The x-axis represents time, the y-axis frequency.

Spectrogram of a transient after applying BWE. The x-axis represents time, the y-axis frequency. Through the application of filter ringing reduction, the filter ringing is reduced by approx. 20dB.

example cross-fade functions, N = 21, Xbias = 8.

| IN1 | IN2 |
|---|---|
| core range | first frequ. tile |
| first frequ. tile | second frequ. tile |
| second frequ. tile | third frequ. tile |

APPARATUS AND METHOD FOR DECODING AN ENCODED AUDIO SIGNAL USING A CROSS-OVER FILTER AROUND A TRANSITION FREQUENCY

CROSS-REFERENCE TO RELATED APPLICATIONS

This application is a continuation of copending International Application No. PCT/EP2014/065112, filed Jul. 15, 2014, which is incorporated herein by reference in its entirety, and which claims priority from European Applications Nos. EP 13177346.7, filed Jul. 22, 2013, EP 13177350.9, filed Jul. 22, 2013, EP 13177353.3, filed Jul. 22, 2013, EP 13177348.3, filed Jul. 22, 2013, and EP 13189389.3, filed Oct. 18, 2013, all of which are incorporated herein by reference in their entirety.

The present invention relates to audio coding/decoding and, particularly, to audio coding using Intelligent Gap Filling (IGF).

BACKGROUND OF THE INVENTION

Audio coding is the domain of signal compression that deals with exploiting redundancy and irrelevancy in audio signals using psychoacoustic knowledge. Today audio codecs typically need around 60 kbps/channel for perceptually transparent coding of almost any type of audio signal. Newer codecs are aimed at reducing the coding bitrate by exploiting spectral similarities in the signal using techniques such as bandwidth extension (BWE). A BWE scheme uses a low bitrate parameter set to represent the high frequency (HF) components of an audio signal. The HF spectrum is filled up with spectral content from low frequency (LF) regions and the spectral shape, tilt and temporal continuity adjusted to maintain the timbre and color of the original signal. Such BWE methods enable audio codecs to retain good quality at even low bitrates of around 24 kbps/channel.

The inventive audio coding system efficiently codes arbitrary audio signals at a wide range of bitrates. Whereas, for high bitrates, the inventive system converges to transparency, for low bitrates perceptual annoyance is minimized. Therefore, the main share of available bitrate is used to waveform code just the perceptually most relevant structure of the signal in the encoder, and the resulting spectral gaps are filled in the decoder with signal content that roughly approximates the original spectrum. A very limited bit budget is consumed to control the parameter driven so-called spectral Intelligent Gap Filling (IGF) by dedicated side information transmitted from the encoder to the decoder.

Storage or transmission of audio signals is often subject to strict bitrate constraints. In the past, coders were forced to drastically reduce the transmitted audio bandwidth when only a very low bitrate was available.

Modern audio codecs are nowadays able to code wideband signals by using bandwidth extension (BWE) methods [1]. These algorithms rely on a parametric representation of the high-frequency content (HF)—which is generated from the waveform coded low-frequency part (LF) of the decoded signal by means of transposition into the HF spectral region ("patching") and application of a parameter driven post processing. In BWE schemes, the reconstruction of the HF spectral region above a given so-called cross-over frequency is often based on spectral patching. Typically, the HF region is composed of multiple adjacent patches and each of these patches is sourced from band-pass (BP) regions of the LF spectrum below the given cross-over frequency. State-of-the-art systems efficiently perform the patching within a filterbank representation, e.g. Quadrature Mirror Filterbank (QMF), by copying a set of adjacent subband coefficients from a source to the target region.

Another technique found in today's audio codecs that increases compression efficiency and thereby enables extended audio bandwidth at low bitrates is the parameter driven synthetic replacement of suitable parts of the audio spectra. For example, noise-like signal portions of the original audio signal can be replaced without substantial loss of subjective quality by artificial noise generated in the decoder and scaled by side information parameters. One example is the Perceptual Noise Substitution (PNS) tool contained in MPEG-4 Advanced Audio Coding (AAC) [5].

A further provision that also enables extended audio bandwidth at low bitrates is the noise filling technique contained in MPEG-D Unified Speech and Audio Coding (USAC) [7]. Spectral gaps (zeroes) that are inferred by the dead-zone of the quantizer due to a too coarse quantization, are subsequently filled with artificial noise in the decoder and scaled by a parameter-driven post-processing.

Another state-of-the-art system is termed Accurate Spectral Replacement (ASR) [2-4]. In addition to a waveform codec, ASR employs a dedicated signal synthesis stage which restores perceptually important sinusoidal portions of the signal at the decoder. Also, a system described in [5] relies on sinusoidal modeling in the HF region of a waveform coder to enable extended audio bandwidth having decent perceptual quality at low bitrates. All these methods involve transformation of the data into a second domain apart from the Modified Discrete Cosine Transform (MDCT) and also fairly complex analysis/synthesis stages for the preservation of HF sinusoidal components.

FIG. 13*a* illustrates a schematic diagram of an audio encoder for a bandwidth extension technology as, for example, used in High Efficiency Advanced Audio Coding (HE-AAC). An audio signal at line 1300 is input into a filter system comprising of a low pass 1302 and a high pass 1304. The signal output by the high pass filter 1304 is input into a parameter extractor/coder 1306. The parameter extractor/coder 1306 is configured for calculating and coding parameters such as a spectral envelope parameter, a noise addition parameter, a missing harmonics parameter, or an inverse filtering parameter, for example. These extracted parameters are input into a bit stream multiplexer 1308. The low pass output signal is input into a processor typically comprising the functionality of a down sampler 1310 and a core coder 1312. The low pass 1302 restricts the bandwidth to be encoded to a significantly smaller bandwidth than occurring in the original input audio signal on line 1300. This provides a significant coding gain due to the fact that the whole functionalities occurring in the core coder only have to operate on a signal with a reduced bandwidth. When, for example, the bandwidth of the audio signal on line 1300 is 20 kHz and when the low pass filter 1302 exemplarily has a bandwidth of 4 kHz, in order to fulfill the sampling theorem, it is theoretically sufficient that the signal subsequent to the down sampler has a sampling frequency of 8 kHz, which is a substantial reduction to the sampling rate that may be used for the audio signal 1300 which has to be at least 40 kHz.

FIG. 13*b* illustrates a schematic diagram of a corresponding bandwidth extension decoder. The decoder comprises a bitstream multiplexer 1320. The bitstream demultiplexer 1320 extracts an input signal for a core decoder 1322 and an input signal for a parameter decoder 1324. A core decoder output signal has, in the above example, a sampling rate of 8 kHz and, therefore, a bandwidth of 4 kHz while, for a complete bandwidth reconstruction, the output signal of a high frequency reconstructor 1330 is at 20 kHz requiring a sampling rate of at least 40 kHz. In order to make this possible, a decoder processor having the functionality of an upsampler 1325 and a filterbank 1326 may be used. The high frequency reconstructor 1330 then receives the frequency-analyzed low frequency signal output by the filterbank 1326 and reconstructs the frequency range defined by the high pass filter 1304 of FIG. 13*a* using the parametric representation of the high frequency band. The high frequency reconstructor 1330 has several functionalities such as the regeneration of the upper frequency range using the source range in the low frequency range, a spectral envelope adjustment, a noise addition functionality and a functionality to introduce missing harmonics in the upper frequency range and, if applied and calculated in the encoder of FIG. 13*a*, an inverse filtering operation in order to account for the fact that the higher frequency range is typically not as tonal as the lower frequency range. In HE-AAC, missing harmonics are re-synthesized on the decoder-side and are placed exactly in the middle of a reconstruction band. Hence, all missing harmonic lines that have been determined in a certain reconstruction band are not placed at the frequency values where they were located in the original signal. Instead, those missing harmonic lines are placed at frequencies in the center of the certain band. Thus, when a missing harmonic line in the original signal was placed very close to the reconstruction band border in the original signal, the error in frequency introduced by placing this missing harmonics line in the reconstructed signal at the center of the band is close to 50% of the individual reconstruction band, for which parameters have been generated and transmitted.

Furthermore, even though the typical audio core coders operate in the spectral domain, the core decoder nevertheless generates a time domain signal which is then, again, converted into a spectral domain by the filter bank 1326 functionality. This introduces additional processing delays, may introduce artifacts due to tandem processing of firstly transforming from the spectral domain into the frequency domain and again transforming into typically a different frequency domain and, of course, this also involves a substantial amount of computation complexity and thereby electric power, which is specifically an issue when the bandwidth extension technology is applied in mobile devices such as mobile phones, tablet or laptop computers, etc.

Current audio codecs perform low bitrate audio coding using BWE as an integral part of the coding scheme. However, BWE techniques are restricted to replace high frequency (HF) content only. Furthermore, they do not allow perceptually important content above a given cross-over frequency to be waveform coded. Therefore, contemporary audio codecs either lose HF detail or timbre when the BWE is implemented, since the exact alignment of the tonal harmonics of the signal is not taken into consideration in most of the systems.

Another shortcoming of the current state of the art BWE systems is the need for transformation of the audio signal into a new domain for implementation of the BWE (e.g. transform from MDCT to QMF domain). This leads to complications of synchronization, additional computational complexity and increased memory requirements.

Storage or transmission of audio signals is often subject to strict bitrate constraints. In the past, coders were forced to drastically reduce the transmitted audio bandwidth when only a very low bitrate was available. Modern audio codecs are nowadays able to code wide-band signals by using bandwidth extension (BWE) methods [1-2]. These algorithms rely on a parametric representation of the high-frequency content (HF)—which is generated from the waveform coded low-frequency part (LF) of the decoded signal by means of transposition into the HF spectral region ("patching") and application of a parameter driven post processing.

In BWE schemes, the reconstruction of the HF spectral region above a given so-called cross-over frequency is often based on spectral patching. Other schemes that are functional to fill spectral gaps, e.g. Intelligent Gap Filling (IGF), use neighboring so-called spectral tiles to regenerate parts of audio signal HF spectra. Typically, the HF region is composed of multiple adjacent patches or tiles and each of these patches or tiles is sourced from band-pass (BP) regions of the LF spectrum below the given cross-over frequency. State-of-the-art systems efficiently perform the patching or tiling within a filterbank representation by copying a set of adjacent subband coefficients from a source to the target region. Yet, for some signal content, the assemblage of the reconstructed signal from the LF band and adjacent patches within the HF band can lead to beating, dissonance and auditory roughness.

Therefore, in [19], the concept of dissonance guard-band filtering is presented in the context of a filterbank-based BWE system. It is suggested to effectively apply a notch filter of approx. 1 Bark bandwidth at the cross-over frequency between LF and BWE-regenerated HF to avoid the possibility of dissonance and replace the spectral content with zeros or noise.

However, the proposed solution in [19] has some drawbacks: First, the strict replacement of spectral content by either zeros or noise can also impair the perceptual quality of the signal. Moreover, the proposed processing is not signal adaptive and can therefore harm perceptual quality in some cases. For example, if the signal contains transients, this can lead to pre- and post-echoes.

Second, dissonances can also occur at transitions between consecutive HF patches. The proposed solution in [19] is only functional to remedy dissonances that occur at cross-over frequency between LF and BWE-regenerated HF.

Last, as opposed to filter bank based systems like proposed in [19], BWE systems can also be realized in transform based implementations, like e.g. the Modified Discrete Cosine Transform (MDCT). Transforms like MDCT are very prone to so-called warbling [20] or ringing artifacts that occur if bandpass regions of spectral coefficients are copied or spectral coefficients are set to zero like proposed in [19].

Particularly, U.S. Pat. No. 8,412,365 discloses to use, in filterbank based translation or folding, so-called guard-bands which are inserted and made of one or several subband channels set to zero. A number of filterbank channels is used as guard-bands, and a bandwidth of a guard-band should be 0.5 Bark. These dissonance guard-bands are partially reconstructed using random white noise signals, i.e., the subbands are fed with white noise instead of being zero. The guard bands are inserted irrespective of the current signal to processed.

Bandwidth extension systems are particularly problematic when they are realized in transform-based implementations like, for example, the Modified Discrete Cosine Transform (MDCT). Transforms like MDCT and other transforms as well are very prone to so-called warbling as discussed in [3]

and ringing artifacts that occur if bandpass regions of spectral coefficients are copied or spectral coefficients are set to zero like proposed in [2].

SUMMARY

According to an embodiment, an apparatus for decoding an encoded audio signal including an encoded core signal may have: a core decoder for decoding the encoded core signal to acquire a decoded core signal; a tile generator for generating one or more spectral tiles including frequencies not included in the decoded core signal using a spectral portion of the decoded core signal; and a cross-over filter for spectrally cross-over filtering the decoded core signal and a first frequency tile including frequencies extending from a gap filling frequency to an upper border frequency or for spectrally cross-over filtering a first frequency tile and a second frequency tile, wherein the cross-over filter is configured to perform a frequency-wise weighted addition of the decoded core signal filtered by a fade-out subfilter and at least a portion of the first frequency tile filtered by a fade-in subfilter within a cross-over range extending over at least three frequency values or to perform a frequency-wise weighted addition of at least a part of a first frequency tile filtered by the fade-out subfilter and at least a part of a second frequency tile filtered by the fade-in subfilter within a cross-over range extending over at least three frequency values.

According to another embodiment, a method of decoding an encoded audio signal including an encoded core signal may have the steps of: decoding the encoded core signal to acquire a decoded core signal; generating one or more spectral tiles including frequencies not included in the decoded core signal using a spectral portion of the decoded core signal; and spectrally cross-over filtering, using a cross-over filter, the decoded core signal and a first frequency tile including frequencies extending from a gap filling frequency to an upper border frequency or for spectrally cross-over filtering a first frequency tile and a second frequency tile, wherein the cross-over filter is configured to perform a frequency-wise weighted addition of the decoded core signal filtered by a fade-out subfilter and at least a portion of the first frequency tile filtered by a fade-in subfilter within a cross-over range extending over at least three frequency values or to perform a frequency-wise weighted addition of at least a part of a first frequency tile filtered by the fade-out subfilter and at least a part of a second frequency tile filtered by the fade-in subfilter within a cross-over range extending over at least three frequency values.

Another embodiment may have a non-transitory digital storage medium for performing, when running on a computer or a processor, the inventive method.

In accordance with the present invention, an apparatus for decoding an encoded audio signal comprises a core decoder, a tile generator for generating one or more spectral tiles having frequencies not included in the decoded core signal using a spectral portion of the decoded core signal and a cross-over filter for spectrally cross-over filtering the decoded core signal and a first frequency tile having frequencies extending from a gap filling frequency to a first tile stop frequency or for spectrally cross-over filtering a tile and a further frequency tile, the further frequency tile having a lower border frequency being frequency-adjacent to an upper border frequency of the frequency tile.

Advantageously, this procedure is intended to be applied within a bandwidth extension based on a transform like the MDCT. However, the present invention is generally applicable and, particularly in a bandwidth extension scenario relying on a quadrature mirror filterbank (QMF), particularly if the system is critically sampled, for example when there is a real-valued QMF representation as a time-frequency conversion or as a frequency-time conversion.

The present invention is particularly useful for transient-like signals, since for such transient-like signals, ringing is an audible and annoying artifact. Filter ringing artifacts are caused by the so-called brick-wall characteristic of a filter in the transition band, i.e., a steep transition from a pass band to a stop band at a cut-off frequency. Such filters can be efficiently implemented by setting one coefficient or groups of coefficients to zero in a frequency domain of a time-frequency transform. Therefore, the present invention relies on a cross-over filter at each transition frequency between patches/tiles or between a core band and a first patch/tile to reduce this ringing artifact. The cross-over filter is advantageously implemented by spectral weighting in the transform domain employing suitable gain functions.

Advantageously, the cross-over filter is signal-adaptive and consists of two filters, a fade-out filter, which is applied to the lower spectral region and a fade-in filter, which is applied to the higher spectral region. The filters can be symmetric or asymmetric depending on the specific implementation.

In a further embodiment, a frequency tile or frequency patch is not only subjected to cross-over filtering, but the tile generator advantageously performs, before performing the cross-over filtering, a patch adaption comprising a setting of frequency borders at local spectral minima and a removal or attenuation of tonal portions remaining in transition ranges around the transition frequencies.

In this embodiment, a decoder-side signal analysis using an analyzer is performed for analyzing the decoded core signal before or after performing a frequency regeneration operation to provide an analysis result. Then, this analysis result is used by a frequency regenerator for regenerating spectral portions not included in the decoded core signal.

Thus, in contrast to a fixed decoder-setting, where the patching or frequency tiling is performed in a fixed way, i.e., where a certain source range is taken from the core signal and certain fixed frequency borders are applied to either set the frequency between the source range and the reconstruction range or the frequency border between two adjacent frequency patches or tiles within the reconstruction range, a signal-dependent patching or tiling is performed, in which, for example, the core signal can be analyzed to find local minima in the core signal and, then, the core range is selected so that the frequency borders of the core range coincide with local minima in the core signal spectrum.

Alternatively or additionally, a signal analysis can be performed on a preliminary regenerated signal or preliminary frequency-patched or tiled signal, wherein, after the preliminary frequency regeneration procedure, the border between the core range and the reconstruction range is analyzed in order to detect any artifact-creating signal portions such as tonal portions being problematic in that they are quite close to each other to generate a beating artifact when being reconstructed. Alternatively or additionally, the borders can also be examined in such a way that a halfway-clipping of a tonal portion is detected and this clipping of a tonal portion would also create an artifact when being reconstructed as it is. In order to avoid these procedures, the frequency border of the reconstruction range and/or the source range and/or between two individual frequency tiles or patches in the reconstruction range can be modified by a signal manipulator in order to again perform a reconstruction with the newly set borders.

Additionally, or alternatively, the frequency regeneration is a regeneration based on the analysis result in that the frequency borders are left as they are and an elimination or at least attenuation of problematic tonal portions near the frequency borders between the source range and the reconstruction range or between two individual frequency tiles or patches within the reconstruction range is done. Such tonal portions can be close tones that would result in a beating artifact or could be clipped tonal portions.

Specifically, when a non-energy conserving transform is used such as an MDCT, a single tone does not directly map to a single spectral line. Instead, a single tone will map to a group of spectral lines with certain amplitudes depending on the phase of the tone. When a patching operation clips this tonal portion, then this will result in an artifact after reconstruction even though a perfect reconstruction is applied as in an MDCT reconstructor. This is due to the fact that the MDCT reconstructor might use the complete tonal pattern for a tone in order to finally correctly reconstruct this tone. Due to the fact that a clipping has taken place before, this is not possible anymore and, therefore, a time varying warbling artifact will be created. Based on the analysis in accordance with the present invention, the frequency regenerator will avoid this situation by attenuating the complete tonal portion creating an artifact or as discussed before, by changing corresponding border frequencies or by applying both measures or by even reconstructing the clipped portion based on a certain pre-knowledge on such tonal patterns.

The inventive approach is mainly intended to be applied within a BWE based on a transform like the MDCT. Nevertheless, the teachings of the invention are generally applicable, e.g. analogously within a Quadrature Mirror Filter bank (QMF) based system, especially if the system is critically sampled, e.g. a real-valued QMF representation.

BRIEF DESCRIPTION OF THE DRAWINGS

Embodiments of the present invention will be detailed subsequently referring to the appended drawings, in which:

FIG. 3*b* illustrates a table indicating the relation between scale factors for scale factor bands and energies for reconstruction bands and noise filling information for a noise filling band;

FIG. 9*c* illustrates a schematic illustrating the functionality of FIG. 9*b;*

DETAILED DESCRIPTION OF THE INVENTION

Figure 6A:
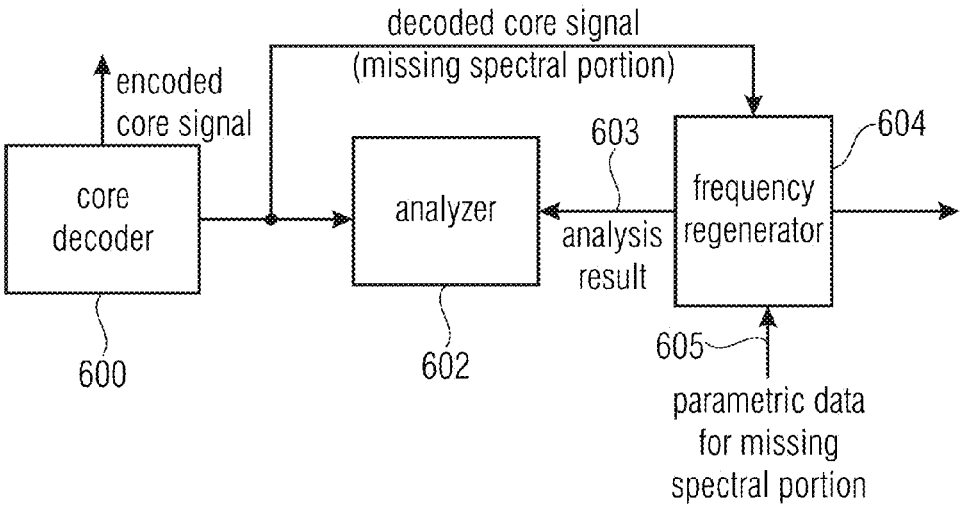
FIG. 6*a* is an apparatus for decoding an encoded audio signal in accordance with one implementation.

FIG. 6*a* illustrates an apparatus for decoding an encoded audio signal comprising an encoded core signal and parametric data. The apparatus comprises a core decoder 600 for decoding the encoded core signal to obtain a decoded core signal, an analyzer 602 for analyzing the decoded core signal before or after performing a frequency regeneration operation. The analyzer 602 is configured for providing an analysis result 603. The frequency regenerator 604 is configured for regenerating spectral portions not included in the decoded core signal using a spectral portion of the decoded core signal, envelope data 605 for the missing spectral portions and the analysis result 603. Thus, in contrast to earlier implementations, the frequency regeneration is not performed on the decoder-side signal-independent, but is performed signal-dependent. This has the advantage that, when no problems exist, the frequency regeneration is performed as it is, but when problematic signal portions exist, then this is detected by the analysis result 603 and the frequency regenerator 604 then performs an adapted way of frequency regeneration which can, for example, be the change of an initial frequency border between the core region and the reconstruction band or the change of a frequency border between two individual tiles/patches within the reconstruction band. Contrary to the implementation of the guard-bands, this has the advantage that specific procedures are only performed if need be and not, as in the guard-band implementation, all the time without any signal-dependency.

Figure 6B:
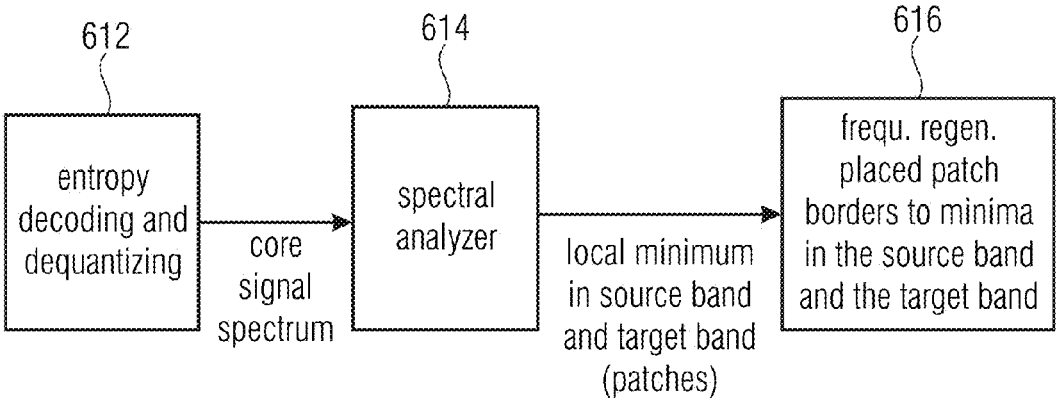
FIG. 6*b* a further embodiment of an apparatus for decoding an encoded audio signal.

Advantageously, the core decoder 600 is implemented as an entropy (e.g. Huffman or arithmetic decoder) decoding and dequantizing stage 612 as illustrated in FIG. 6*b*. The core decoder 600 then outputs a core signal spectrum and the spectrum is analyzed by the spectral analyzer 614 which is, quite similar to the analyzer 602 in FIG. 6*a*. implemented as a spectral analyzer rather than any arbitrary analyzer which could, as illustrated in FIG. 6*a*, also analyze a time domain signal. In the embodiment of FIG. 6*b*, the spectral analyzer is configured for analyzing the spectral signal so that local minima in the source band and/or in a target band, i.e., in the frequency patches or frequency tiles are determined. Then, the frequency regenerator 604 performs, as illustrated at 616, a frequency regeneration where the patch borders are placed to minima in the source band and/or the target band.

Figure 7A:
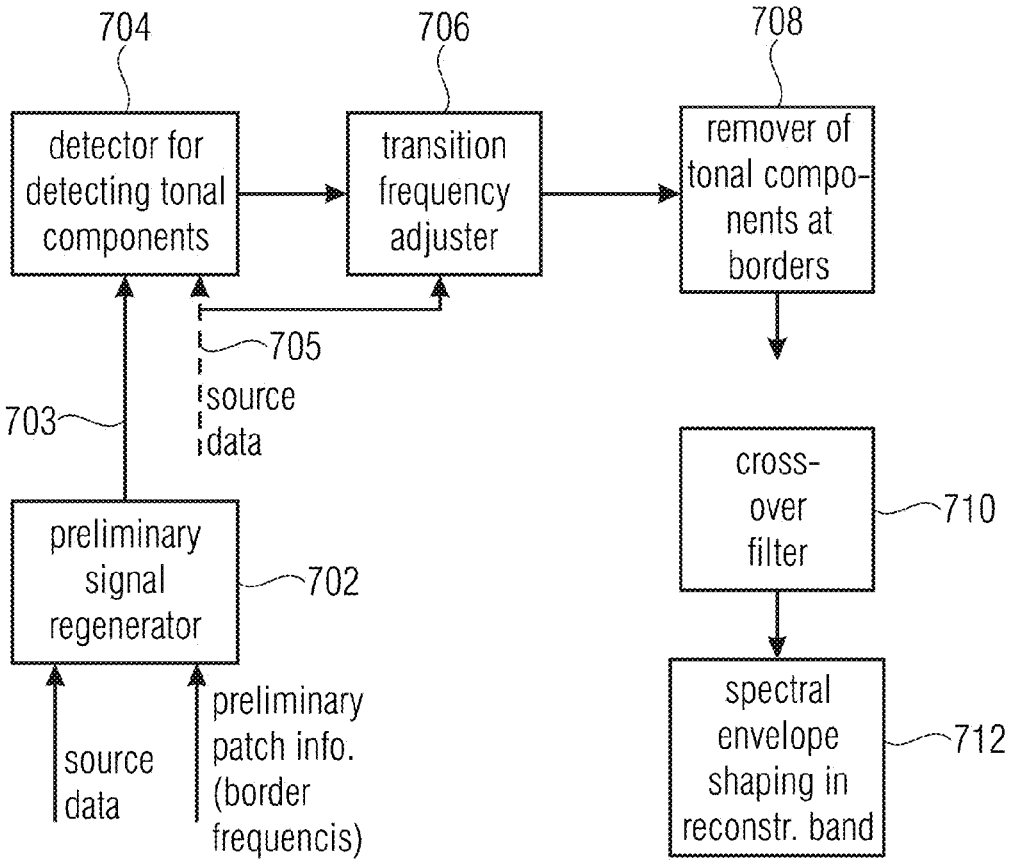
FIG. 7*a* illustrates an advantageous implementation of the frequency regenerator of FIG. 6*a* or 6*b;*

Subsequently, FIG. 7*a* is discussed in order to describe an advantageous implementation of the frequency regenerator 604 of FIG. 6*a*. A preliminary signal regenerator 702 receives, as an input, source data from the source band and, additionally, preliminary patch information such as preliminary border frequencies. Then, a preliminary regenerated signal 703 is generated, which is detected by the detector 704 for detecting the tonal components within the preliminary reconstructed signal 703. Alternatively or additionally, the source data 705 can also be analyzed by the detector corresponding to the analyzer 602 of FIG. 6*a*. Then, the preliminary signal regeneration step would not be necessary. When there is a well-defined mapping from the source data to the reconstruction data, then the minima or tonal portions can be detected even by considering only the source data, whether there are tonal portions close to the upper border of the core range or at a frequency border between two individually generated frequency tiles as will be discussed later with respect to FIG. 12*b*.

In case problematic tonal components have been discovered near frequency borders, a transition frequency adjuster 706 performs an adjustment of a transition frequency such as a transition frequency or cross-over frequency or gap filling start frequency between the core band and the reconstruction band or between individual frequency portions generated by one and the same source data in the reconstruction band. The output signal of block 706 is forwarded to a remover 708 of tonal components at borders. The remover is configured for removing remaining tonal components which are still there subsequent to the transition frequency adjustment by block 706. The result of the remover 708 is then forwarded to a cross-over filter 710 in order to address the filter ringing problem and the result of the cross-over filter 710 is then input into a spectral envelope shaping block 712 which performs a spectral envelope shaping in the reconstruction band.

Figure 7B:
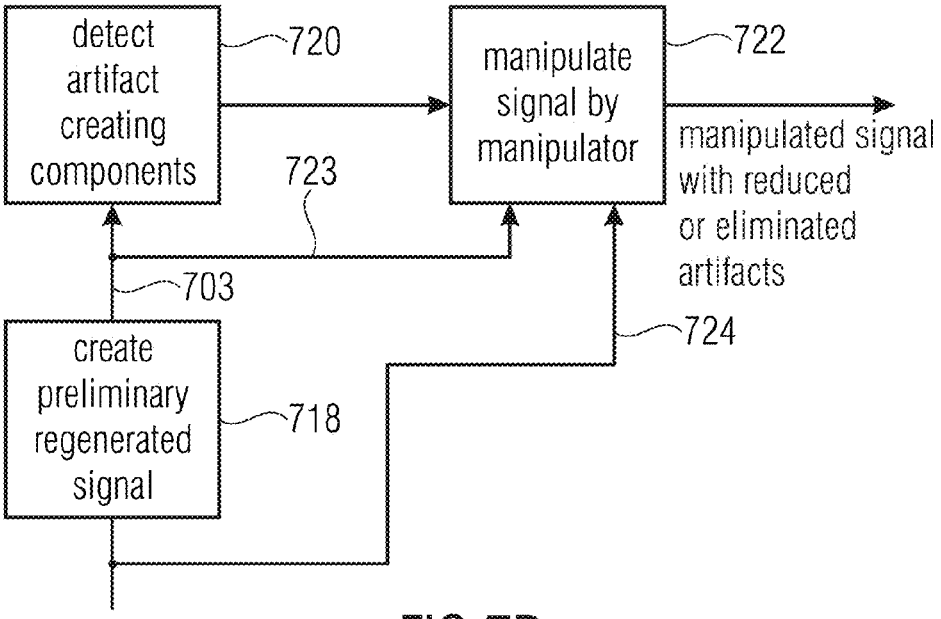
FIG. 7*b* illustrates a further implementation of a cooperation between the analyzer and the frequency regenerator.

As discussed in the context of FIG. 7*a*, the detection of tonal components in block 704 can be both performed on a source data 705 or a preliminary reconstructed signal 703. This embodiment is illustrated in FIG. 7*b*, where a preliminary regenerated signal is created as shown in block 718. The signal corresponding to signal 703 of FIG. 7*a* is then forwarded to a detector 720 which detects artifact-creating components. Although the detector 720 can be configured for being a detector for detecting tonal components at frequency borders as illustrated at 704 in FIG. 7*a*, the detector can also be implemented to detect other artifact-creating components. Such spectral components can be even other components than tonal components and a detection whether an artifact has been created can be performed by trying different regenerations and comparing the different regeneration results in order to find out which one has provided artifact-creating components.

The detector 720 now controls a manipulator 722 for manipulating the signal, i.e., the preliminary regenerated signal. This manipulation can be done by actually processing the preliminary regenerated signal by line 723 or by newly performing a regeneration, but now with, for example, the amended transition frequencies as illustrated by line 724.

Figure 8A:
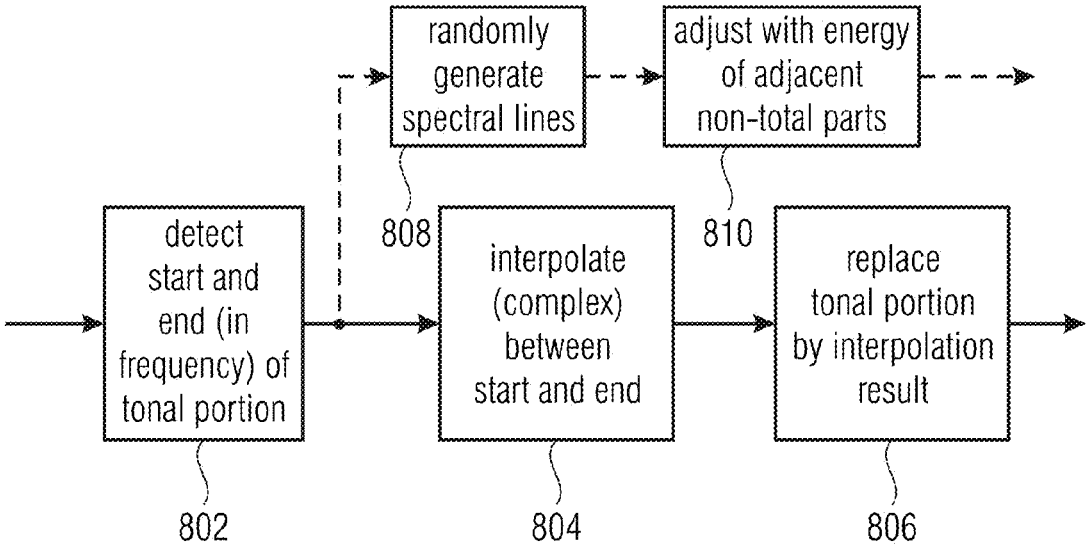
FIG. 8*a* illustrates a further implementation of the frequency regenerator.

One implementation of the manipulation procedure is that the transition frequency is adjusted as illustrated at 706 in FIG. 7*a*. A further implementation is illustrated in FIG. 8*a*, which can be performed instead of block 706 or together with block 706 of FIG. 7*a*. A detector 802 is provided for detecting start and end frequencies of a problematic tonal portion. Then, an interpolator 804 is configured for interpolating and, advantageously complex interpolating between the start and the end of the tonal portion within the spectral range. Then, as illustrated in FIG. 8*a* by block 806, the tonal portion is replaced by the interpolation result.

An alternative implementation is illustrated in FIG. 8*a* by blocks 808, 810. Instead of performing an interpolation, a random generation of spectral lines 808 is performed between the start and the end of the tonal portion. Then, an energy adjustment of the randomly generated spectral lines is performed as illustrated at 810, and the energy of the randomly generated spectral lines is set so that the energy is similar to the adjacent non-tonal spectral parts. Then, the tonal portion is replaced by envelope-adjusted randomly generated spectral lines. The spectral lines can be randomly generated or pseudo randomly generated in order to provide a replacement signal which is, as far as possible, artifact-free.

Figure 8B:
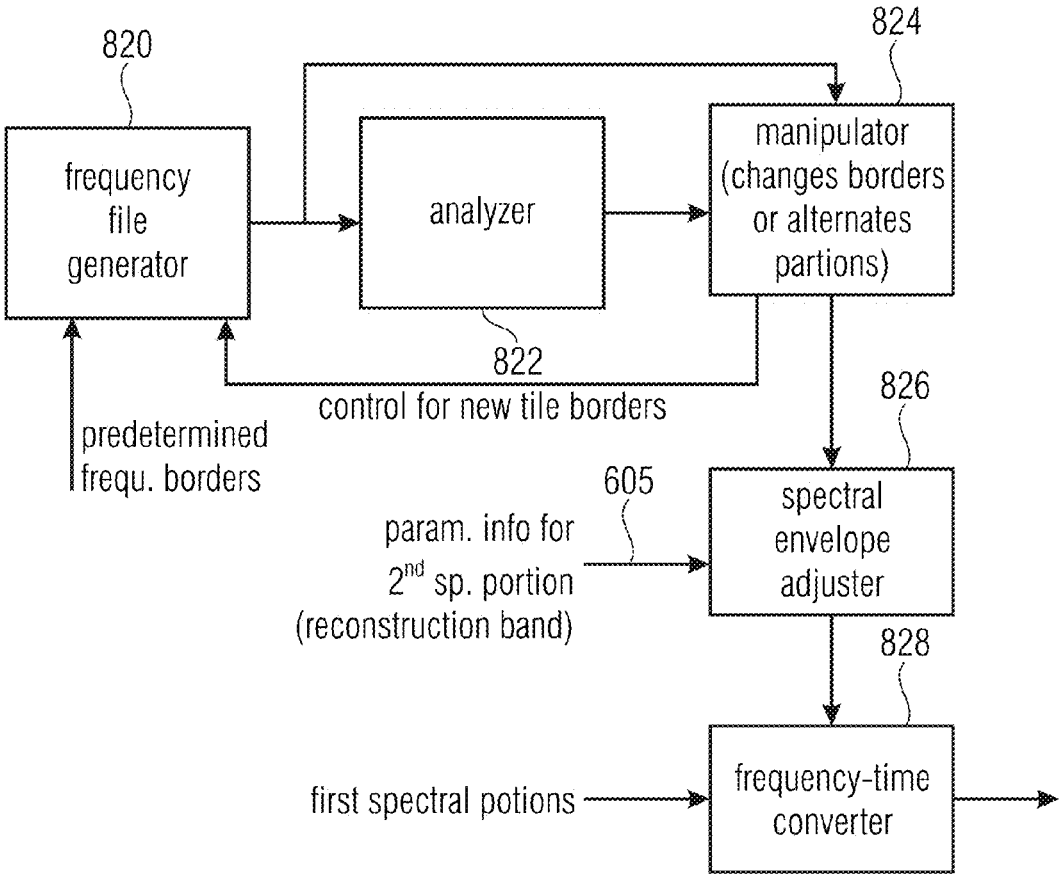
FIG. 8*b* illustrates a further embodiment of the invention.

A further implementation is illustrated in FIG. 8*b*. A frequency tile generator located within the frequency regenerator 604 of FIG. 6*a* is illustrated at block 820. The frequency tile generator uses predetermined frequency borders. Then, the analyzer analyzes the signal generated by the frequency tile generator, and the frequency tile generator 820 is advantageously configured for performing multiple tiling operations to generate multiple frequency tiles. Then, the manipulator 824 in FIG. 8*b* manipulates the result of the frequency tile generator in accordance with the analysis result output by the analyzer 822. The manipulation can be the change of frequency borders or the attenuation of individual portions. Then, a spectral envelope adjuster 826 performs a spectral envelope adjustment using the parametric information 605 as already discussed in the context of FIG. 6*a*.

Then, the spectrally adjusted signal output by block 826 is input into a frequency-time converter which, additionally, receives the first spectral portions, i.e., a spectral representation of the output signal of the core decoder 600. The output of the frequency-time converter 828 can then be used for storage or for transmitting to a loudspeaker for audio rendering.

Figure 13A:
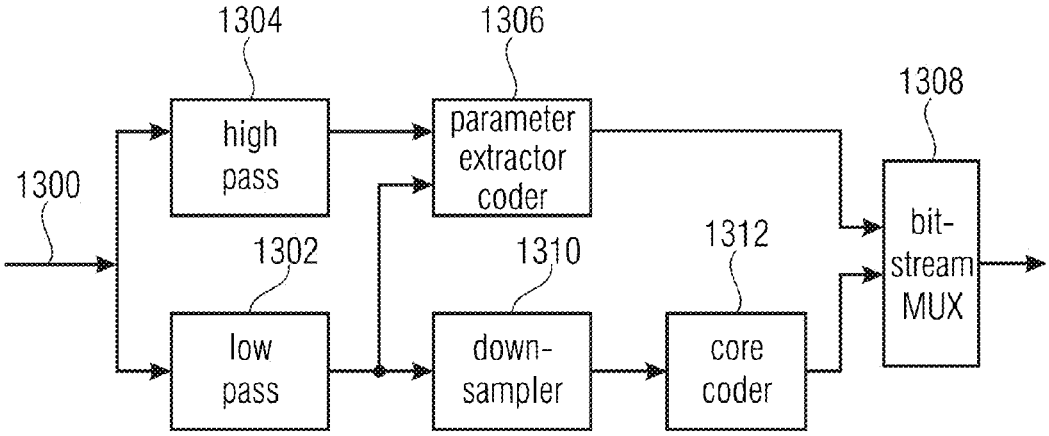
FIG 13A (PRIOR ART)
FIG. 13*a* illustrates a conventional-technology encoder with bandwidth extension.
Figure 13B:
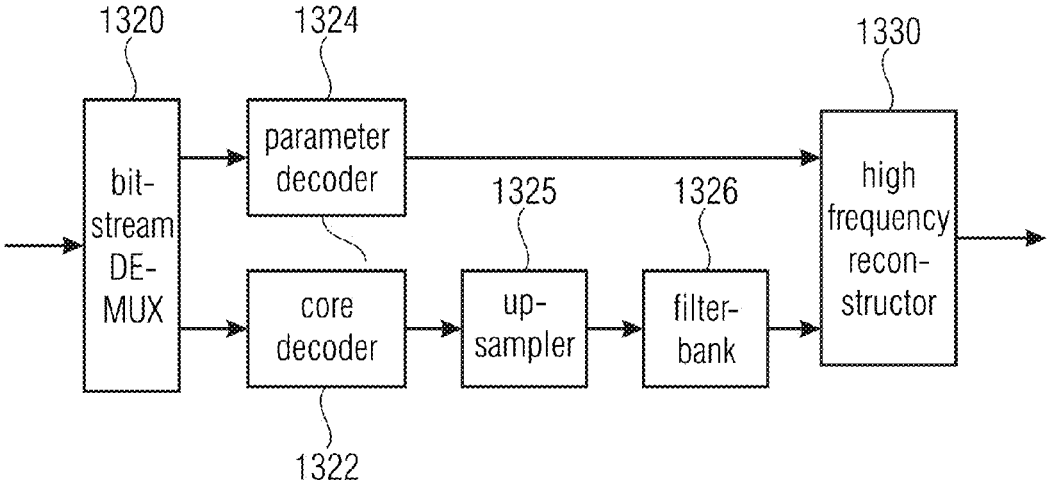
FIG 13B (PRIOR ART)
FIG. 13*b* illustrates a conventional-technology decoder with bandwidth extension.

The present invention can be applied either to known frequency regeneration procedures such as illustrated in FIGS. 13*a*, 13*b* or can advantageously be applied within the intelligent gap filling context, which is subsequently described with respect to FIGS. 1*a* to 5*b* and 9*a* to 10*d*.

Figure 1A:
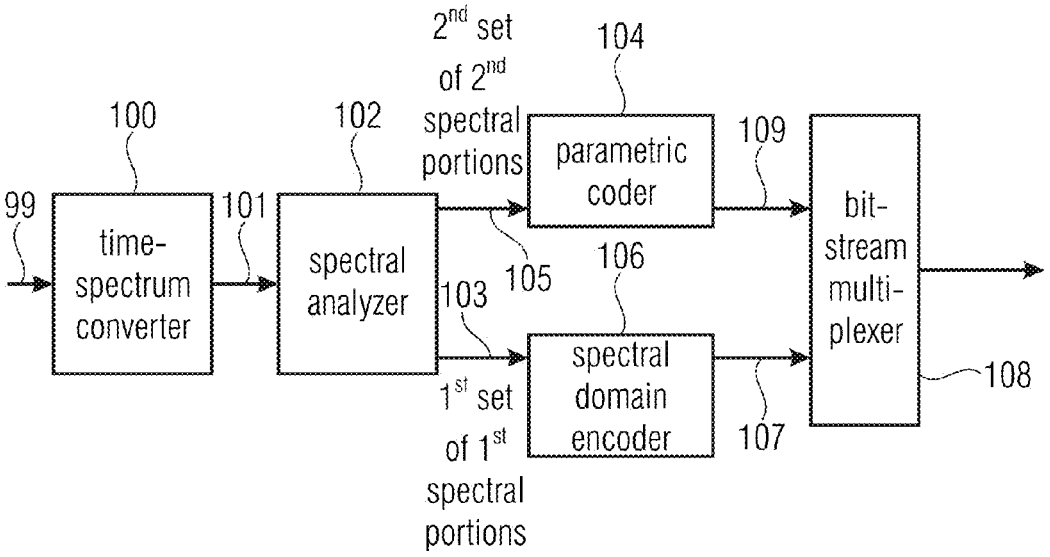
FIG. 1*a* illustrates an apparatus for encoding an audio signal.

FIG. 1*a* illustrates an apparatus for encoding an audio signal 99. The audio signal 99 is input into a time spectrum converter 100 for converting an audio signal having a sampling rate into a spectral representation 101 output by the time spectrum converter. The spectrum 101 is input into a spectral analyzer 102 for analyzing the spectral representation 101. The spectral analyzer 101 is configured for determining a first set of first spectral portions 103 to be encoded with a first spectral resolution and a different second set of second spectral portions 105 to be encoded with a second spectral resolution. The second spectral resolution is smaller than the first spectral resolution. The second set of second spectral portions 105 is input into a parameter calculator or parametric coder 104 for calculating spectral envelope information having the second spectral resolution. Furthermore, a spectral domain audio coder 106 is provided for generating a first encoded representation 107 of the first set of first spectral portions having the first spectral resolution. Furthermore, the parameter calculator/parametric coder 104 is configured for generating a second encoded representation 109 of the second set of second spectral portions. The first encoded representation 107 and the second encoded representation 109 are input into a bit stream multiplexer or bit stream former 108 and block 108 finally outputs the encoded audio signal for transmission or storage on a storage device.

Figure 1B:
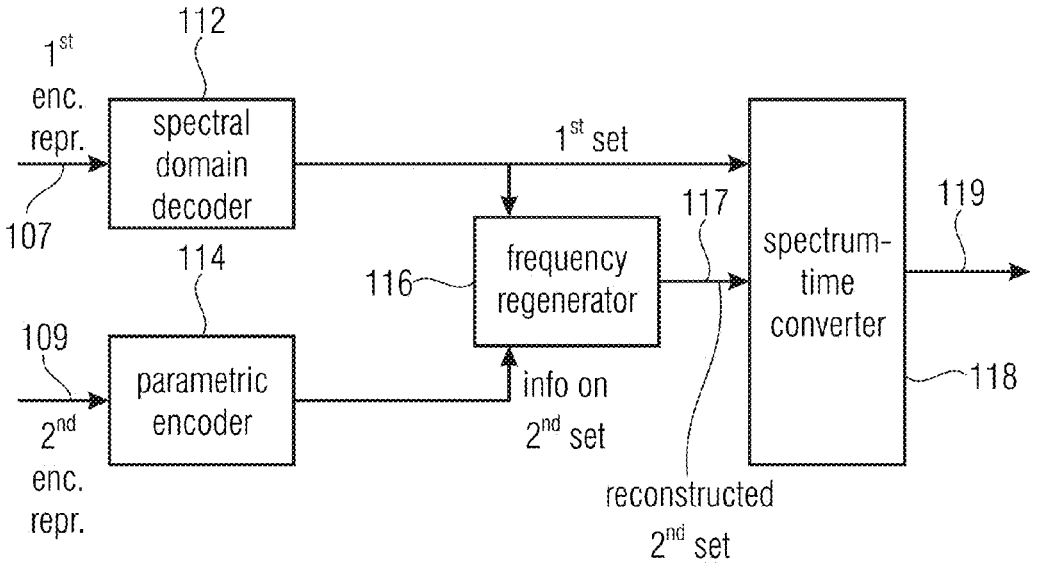
FIG. 1*b* illustrates a decoder for decoding an encoded audio signal matching with the encoder of FIG. 1*a;*
Figure 3A:
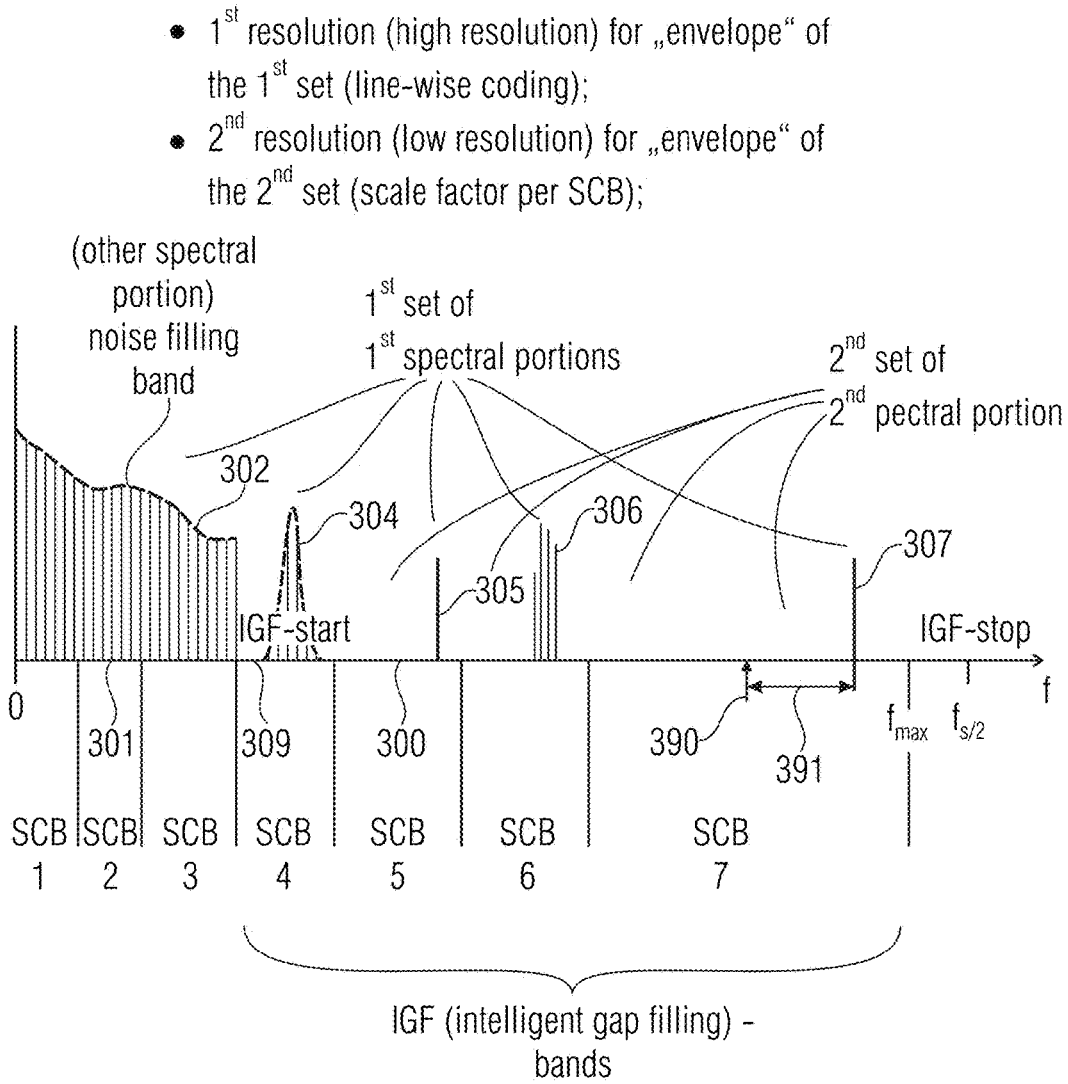
FIG. 3*a* illustrates a schematic representation of a spectrum as generated by the spectral domain decoder of FIG. 1*b;*

Typically, a first spectral portion such as 306 of FIG. 3*a* will be surrounded by two second spectral portions such as 307*a*, 307*b*. This is not the case in HE AAC, where the core coder frequency range is band limited FIG. 1*b* illustrates a decoder matching with the encoder of FIG. 1*a*. The first encoded representation 107 is input into a spectral domain audio decoder 112 for generating a first decoded representation of a first set of first spectral portions, the decoded representation having a first spectral resolution. Furthermore, the second encoded representation 109 is input into a parametric decoder 114 for generating a second decoded representation of a second set of second spectral portions having a second spectral resolution being lower than the first spectral resolution.

The decoder further comprises a frequency regenerator 116 for regenerating a reconstructed second spectral portion having the first spectral resolution using a first spectral portion. The frequency regenerator 116 performs a tile filling operation, i.e., uses a tile or portion of the first set of first spectral portions and copies this first set of first spectral portions into the reconstruction range or reconstruction band having the second spectral portion and typically performs spectral envelope shaping or another operation as indicated by the decoded second representation output by the parametric decoder 114, i.e., by using the information on the second set of second spectral portions. The decoded first set of first spectral portions and the reconstructed second set of spectral portions as indicated at the output of the frequency regenerator 116 on line 117 is input into a spectrum-time converter 118 configured for converting the first decoded representation and the reconstructed second spectral portion into a time representation 119, the time representation having a certain high sampling rate.

Figure 2A:
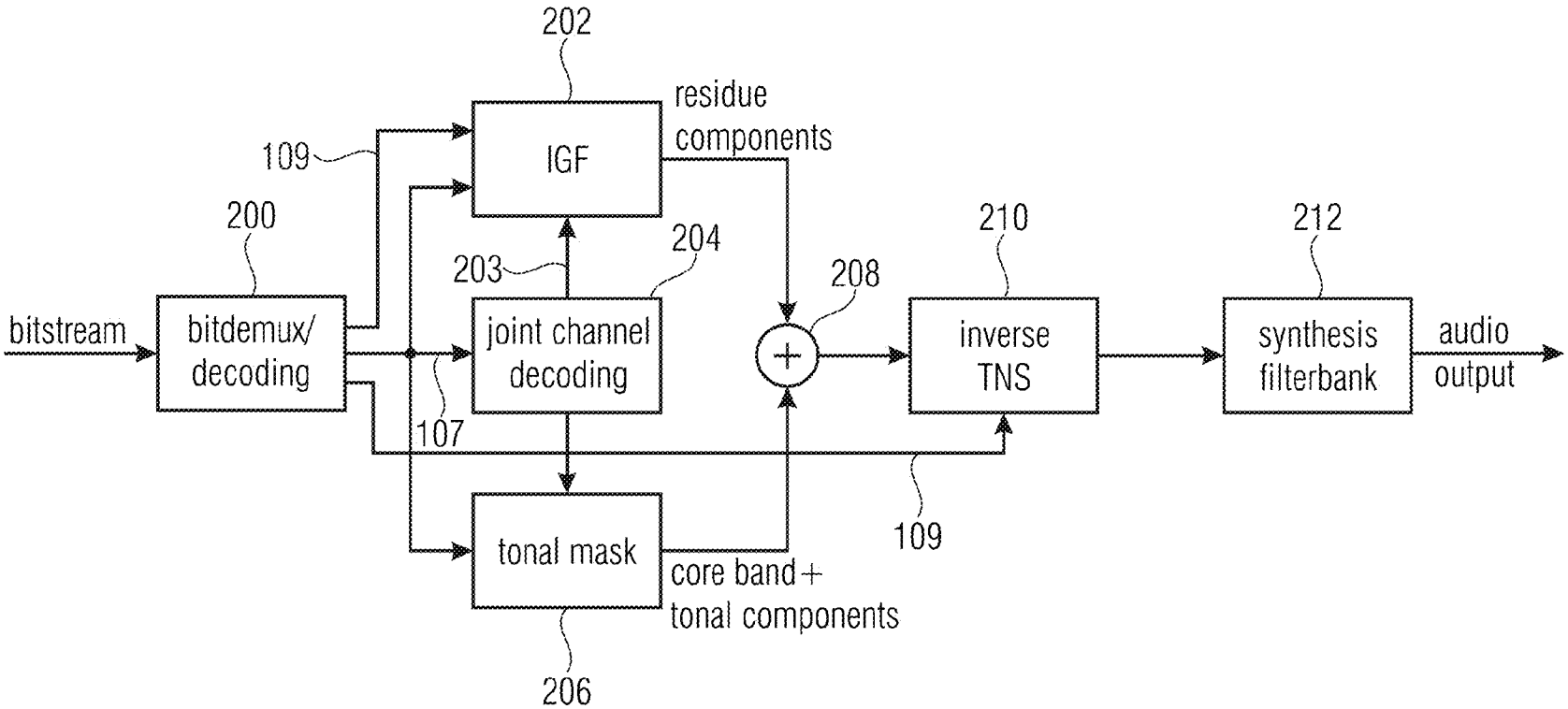
FIG. 2*a* illustrates an advantageous implementation of the decoder.
Figure 2B:
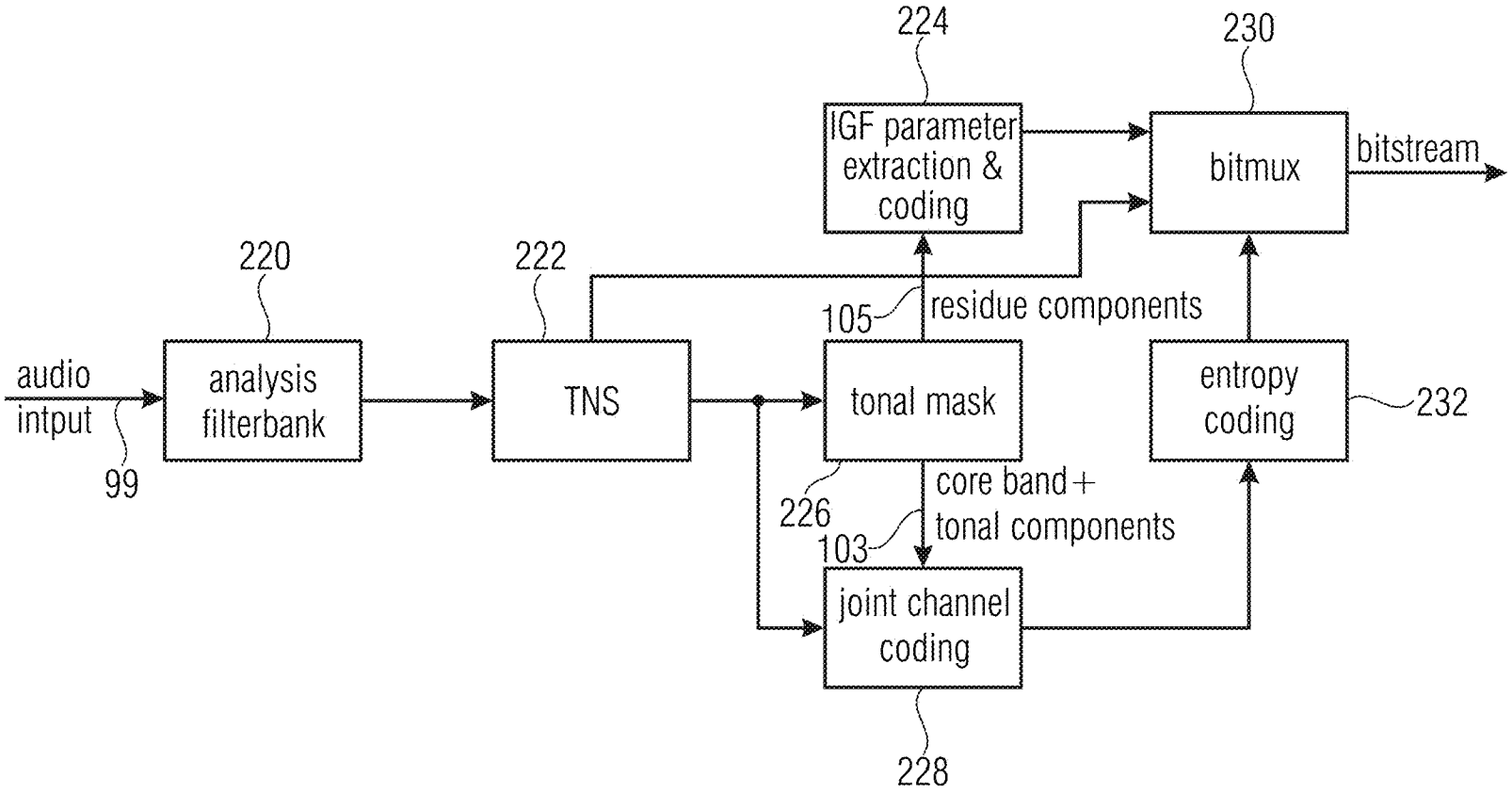
FIG. 2*b* illustrates an advantageous implementation of the encoder.

FIG. 2*b* illustrates an implementation of the FIG. 1*a* encoder. An audio input signal 99 is input into an analysis filterbank 220 corresponding to the time spectrum converter 100 of FIG. 1*a*. Then, a temporal noise shaping operation is performed in TNS block 222. Therefore, the input into the spectral analyzer 102 of FIG. 1*a* corresponding to a block tonal mask 226 of FIG. 2*b* can either be full spectral values, when the temporal noise shaping/temporal tile shaping operation is not applied or can be spectral residual values, when the TNS operation as illustrated in FIG. 2*b*, block 222 is applied. For two-channel signals or multi-channel signals, a joint channel coding 228 can additionally be performed, so that the spectral domain encoder 106 of FIG. 1*a* may comprise the joint channel coding block 228. Furthermore, an entropy coder 232 for performing a lossless data compression is provided which is also a portion of the spectral domain encoder 106 of FIG. 1*a*.

The spectral analyzer/tonal mask 226 separates the output of TNS block 222 into the core band and the tonal components corresponding to the first set of first spectral portions 103 and the residual components corresponding to the second set of second spectral portions 105 of FIG. 1*a*. The block 224 indicated as IGF parameter extraction encoding corresponds to the parametric coder 104 of FIG. 1*a* and the bitstream multiplexer 230 corresponds to the bitstream multiplexer 108 of FIG. 1*a*.

Advantageously, the analysis filterbank 222 is implemented as an MDCT (modified discrete cosine transform filterbank) and the MDCT is used to transform the signal 99 into a time-frequency domain with the modified discrete cosine transform acting as the frequency analysis tool.

The spectral analyzer 226 advantageously applies a tonality mask. This tonality mask estimation stage is used to separate tonal components from the noise-like components in the signal. This allows the core coder 228 to code all tonal components with a psycho-acoustic module. The tonality mask estimation stage can be implemented in numerous different ways and is advantageously implemented similar in its functionality to the sinusoidal track estimation stage used in sine and noise-modeling for speech/audio coding [8, 9] or an HILN model based audio coder described in [10]. Advantageously, an implementation is used which is easy to implement without the need to maintain birth-death trajectories, but any other tonality or noise detector can be used as well.

The IGF module calculates the similarity that exists between a source region and a target region. The target region will be represented by the spectrum from the source region. The measure of similarity between the source and target regions is done using a cross-correlation approach. The target region is split into nTar non-overlapping frequency tiles. For every tile in the target region, nSrc source tiles are created from a fixed start frequency. These source tiles overlap by a factor between 0 and 1, where 0 means 0% overlap and 1 means 100% overlap. Each of these source tiles is correlated with the target tile at various lags to find the source tile that best matches the target tile. The best matching tile number is stored in tileNum[idx_tar], the lag at which it best correlates with the target is stored in xcorr_lag[idx_tar][idx_src] and the sign of the correlation is stored in xcorr_sign[idx_tar][idx_src]. In case the correlation is highly negative, the source tile needs to be multiplied by −1 before the tile filling process at the decoder. The IGF module also takes care of not overwriting the tonal components in the spectrum since the tonal components are preserved using the tonality mask. A band-wise energy parameter is used to store the energy of the target region enabling us to reconstruct the spectrum accurately.

This method has certain advantages over the classical SBR [1] in that the harmonic grid of a multi-tone signal is preserved by the core coder while only the gaps between the sinusoids is filled with the best matching "shaped noise" from the source region. Another advantage of this system compared to ASR (Accurate Spectral Replacement) [2-4] is the absence of a signal synthesis stage which creates the important portions of the signal at the decoder. Instead, this task is taken over by the core coder, enabling the preservation of important components of the spectrum. Another advantage of the proposed system is the continuous scalability that the features offer. Just using tileNum[idx_tar] and xcorr_lag=0, for every tile is called gross granularity matching and can be used for low bitrates while using variable xcorr_lag for every tile enables us to match the target and source spectra better.

In addition, a tile choice stabilization technique is proposed which removes frequency domain artifacts such as trilling and musical noise.

In case of stereo channel pairs an additional joint stereo processing is applied. This is useful because for a certain destination range the signal can a highly correlated panned sound source. In case the source regions chosen for this particular region are not well correlated, although the energies are matched for the destination regions, the spatial image can suffer due to the uncorrelated source regions. The encoder analyses each destination region energy band, typically performing a cross-correlation of the spectral values and if a certain threshold is exceeded, sets a joint flag for this energy band. In the decoder the left and right channel energy bands are treated individually if this joint stereo flag is not set. In case the joint stereo flag is set, both the energies and the patching are performed in the joint stereo domain. The joint stereo information for the IGF regions is signaled similar the joint stereo information for the core coding, including a flag indicating in case of prediction if the direction of the prediction is from downmix to residual or vice versa.

The energies can be calculated from the transmitted energies in the L/R-domain.

$$midNrg[k]=leftNrg[k]+rightNrg[k];$$

$$sideNrg[k]=leftNrg[k]-rightNrg[k];$$

with k being the frequency index in the transform domain.

Another solution is to calculate and transmit the energies directly in the joint stereo domain for bands where joint stereo is active, so no additional energy transformation is needed at the decoder side.

The source tiles are created according to the Mid/Side-Matrix:

$$midTile[k]=0.5\cdot(leftTile[k]+rightTile[k])$$

$$sideTile[k]=0.5\cdot(leftTile[k]-rightTile[k])$$

Energy adjustment:

$$midTile[k]=midTile[k]*midNrg[k];$$

$$sideTile[k]=sideTile[k]*sideNrg[k];$$

Joint stereo→LR transformation:

If no additional prediction parameter is coded:

$$leftTile[k]=midTile[k]+sideTile[k]$$

$$rightTile[k]=midTile[k]-sideTile[k]$$

If an additional prediction parameter is coded and if the signalled direction is from mid to side:

$$sideTile[k]=sideTile[k]-predictionCoeff\cdot midTile[k]$$

$$leftTile[k]=midTile[k]+sideTile[k]$$

$$rightTile[k]=midTile[k]-sideTile[k]$$

If the signalled direction is from side to mid:

$$midTile1[k]=midTile[k]-predictionCoeff\cdot sideTile[k]$$

$$leftTile[k]=midTile1[k]-sideTile[k]$$

$$rightTile[k]=midTile1[k]+sideTile[k]$$

This processing ensures that from the tiles used for regenerating highly correlated destination regions and panned destination regions, the resulting left and right channels still represent a correlated and panned sound source even if the source regions are not correlated, preserving the stereo image for such regions.

In other words, in the bitstream, joint stereo flags are transmitted that indicate whether L/R or M/S as an example for the general joint stereo coding shall be used. In the decoder, first, the core signal is decoded as indicated by the joint stereo flags for the core bands. Second, the core signal is stored in both L/R and M/S representation. For the IGF tile filling, the source tile representation is chosen to fit the target tile representation as indicated by the joint stereo information for the IGF bands.

Temporal Noise Shaping (TNS) is a standard technique and part of AAC [11-13]. TNS can be considered as an extension of the basic scheme of a perceptual coder, inserting an optional processing step between the filterbank and the quantization stage. The main task of the TNS module is to hide the produced quantization noise in the temporal masking region of transient like signals and thus it leads to a more efficient coding scheme. First, TNS calculates a set of prediction coefficients using "forward prediction" in the transform domain, e.g. MDCT. These coefficients are then used for flattening the temporal envelope of the signal. As the quantization affects the TNS filtered spectrum, also the quantization noise is temporarily flat. By applying the invers TNS filtering on decoder side, the quantization noise is shaped according to the temporal envelope of the TNS filter and therefore the quantization noise gets masked by the transient.

IGF is based on an MDCT representation. For efficient coding, advantageously long blocks of approx. 20 ms have to be used. If the signal within such a long block contains transients, audible pre- and post-echoes occur in the IGF spectral bands due to the tile filling. FIG. 7*c* shows a typical pre-echo effect before the transient onset due to IGF. On the left side, the spectrogram of the original signal is shown and on the right side the spectrogram of the bandwidth extended signal without TNS filtering is shown.

This pre-echo effect is reduced by using TNS in the IGF context. Here, TNS is used as a temporal tile shaping (TTS) tool as the spectral regeneration in the decoder is performed on the TNS residual signal. The TTS prediction coefficients that may be used are calculated and applied using the full spectrum on encoder side as usual. The TNS/TTS start and stop frequencies are not affected by the IGF start frequency $f_{IGFstart}$ of the IGF tool. In comparison to the legacy TNS, the TTS stop frequency is increased to the stop frequency of the IGF tool, which is higher than $f_{IGFstart}$. On decoder side the TNS/TTS coefficients are applied on the full spectrum again, i.e. the core spectrum plus the regenerated spectrum plus the tonal components from the tonality map (see FIG. 7*e*). The application of TTS may be used to form the temporal envelope of the regenerated spectrum to match the envelope of the original signal again. So the shown pre-echoes are reduced. In addition, it still shapes the quantization noise in the signal below $f_{IGFstart}$ as usual with TNS.

In legacy decoders, spectral patching on an audio signal corrupts spectral correlation at the patch borders and thereby impairs the temporal envelope of the audio signal by introducing dispersion. Hence, another benefit of performing the IGF tile filling on the residual signal is that, after application of the shaping filter, tile borders are seamlessly correlated, resulting in a more faithful temporal reproduction of the signal.

In an inventive encoder, the spectrum having undergone TNS/TTS filtering, tonality mask processing and IGF parameter estimation is devoid of any signal above the IGF start frequency except for tonal components. This sparse spectrum is now coded by the core coder using principles of arithmetic coding and predictive coding. These coded components along with the signaling bits form the bitstream of the audio.

FIG. 2*a* illustrates the corresponding decoder implementation. The bitstream in FIG. 2*a* corresponding to the encoded audio signal is input into the demultiplexer/decoder which would be connected, with respect to FIG. 1*b*, to the blocks 112 and 114. The bitstream demultiplexer separates the input audio signal into the first encoded representation 107 of FIG. 1*b* and the second encoded representation 109 of FIG. 1*b*. The first encoded representation having the first set of first spectral portions is input into the joint channel decoding block 204 corresponding to the spectral domain decoder 112 of FIG. 1*b*. The second encoded representation is input into the parametric decoder 114 not illustrated in FIG. 2*a* and then input into the IGF block 202 corresponding to the frequency regenerator 116 of FIG. 1*b*. The first set of first spectral portions that may be used for frequency regeneration are input into IGF block 202 via line 203. Furthermore, subsequent to joint channel decoding 204 the specific core decoding is applied in the tonal mask block 206 so that the output of tonal mask 206 corresponds to the output of the spectral domain decoder 112. Then, a combination by combiner 208 is performed, i.e., a frame building where the output of combiner 208 now has the full range spectrum, but still in the TNS/TTS filtered domain. Then, in block 210, an inverse TNS/TTS operation is performed using TNS/TTS filter information provided via line 109, i.e., the TTS side information is advantageously included in the first encoded representation generated by the spectral domain encoder 106 which can, for example, be a straightforward AAC or USAC core encoder, or can also be included in the second encoded representation. At the output of block 210, a complete spectrum until the maximum frequency is provided which is the full range frequency defined by the sampling rate of the original input signal. Then, a spectrum/time conversion is performed in the synthesis filterbank 212 to finally obtain the audio output signal.

FIG. 3*a* illustrates a schematic representation of the spectrum. The spectrum is subdivided in scale factor bands SCB where there are seven scale factor bands SCB1 to SCB7 in the illustrated example of FIG. 3*a*. The scale factor bands can be AAC scale factor bands which are defined in the AAC standard and have an increasing bandwidth to upper frequencies as illustrated in FIG. 3*a* schematically. It is advantageous to perform intelligent gap filling not from the very beginning of the spectrum, i.e., at low frequencies, but to start the IGF operation at an IGF start frequency illustrated at 309. Therefore, the core frequency band extends from the lowest frequency to the IGF start frequency. Above the IGF start frequency, the spectrum analysis is applied to separate high resolution spectral components 304, 305, 306, 307 (the first set of first spectral portions) from low resolution components represented by the second set of second spectral portions. FIG. 3*a* illustrates a spectrum which is exemplarily input into the spectral domain encoder 106 or the joint channel coder 228, i.e., the core encoder operates in the full range, but encodes a significant amount of zero spectral values, i.e., these zero spectral values are quantized to zero or are set to zero before quantizing or subsequent to quantizing. Anyway, the core encoder operates in full range, i.e., as if the spectrum would be as illustrated, i.e., the core decoder does not necessarily have to be aware of any intelligent gap filling or encoding of the second set of second spectral portions with a lower spectral resolution.

Advantageously, the high resolution is defined by a line-wise coding of spectral lines such as MDCT lines, while the second resolution or low resolution is defined by, for example, calculating only a single spectral value per scale factor band, where a scale factor band covers several frequency lines. Thus, the second low resolution is, with respect to its spectral resolution, much lower than the first or high resolution defined by the line-wise coding typically applied by the core encoder such as an AAC or USAC core encoder.

Regarding scale factor or energy calculation, the situation is illustrated in FIG. 3*b*. Due to the fact that the encoder is a core encoder and due to the fact that there can, but does not necessarily have to be, components of the first set of spectral portions in each band, the core encoder calculates a scale factor for each band not only in the core range below the IGF start frequency 309, but also above the IGF start frequency until the maximum frequency $f_{IGFstop}$ which is smaller or equal to the half of the sampling frequency, i.e., $f_{s/2}$. Thus, the encoded tonal portions 302, 304, 305, 306, 307 of FIG. 3*a* and, in this embodiment together with the scale factors SCB1 to SCB7 correspond to the high resolution spectral data. The low resolution spectral data are calculated starting from the IGF start frequency and correspond to the energy information values $E_1$, $E_2$, $E_3$, $E_4$, which are transmitted together with the scale factors SF4 to SF7.

Particularly, when the core encoder is under a low bitrate condition, an additional noise-filling operation in the core band, i.e., lower in frequency than the IGF start frequency, i.e., in scale factor bands SCB1 to SCB3 can be applied in addition. In noise-filling, there exist several adjacent spectral lines which have been quantized to zero. On the decoder-side, these quantized to zero spectral values are re-synthesized and the re-synthesized spectral values are adjusted in their magnitude using a noise-filling energy such as $NF_2$ illustrated at 308 in FIG. 3*b*. The noise-filling energy, which can be given in absolute terms or in relative terms particularly with respect to the scale factor as in USAC corresponds to the energy of the set of spectral values quantized to zero. These noise-filling spectral lines can also be considered to be a third set of third spectral portions which are regenerated by straightforward noise-filling synthesis without any IGF operation relying on frequency regeneration using frequency tiles from other frequencies for reconstructing frequency tiles using spectral values from a source range and the energy information $E_1$, $E_2$, $E_3$, $E_4$.

Advantageously, the bands, for which energy information is calculated coincide with the scale factor bands. In other embodiments, an energy information value grouping is applied so that, for example, for scale factor bands 4 and 5, only a single energy information value is transmitted, but even in this embodiment, the borders of the grouped reconstruction bands coincide with borders of the scale factor bands. If different band separations are applied, then certain re-calculations or synchronization calculations may be applied, and this can make sense depending on the certain implementation.

Figure 4A:
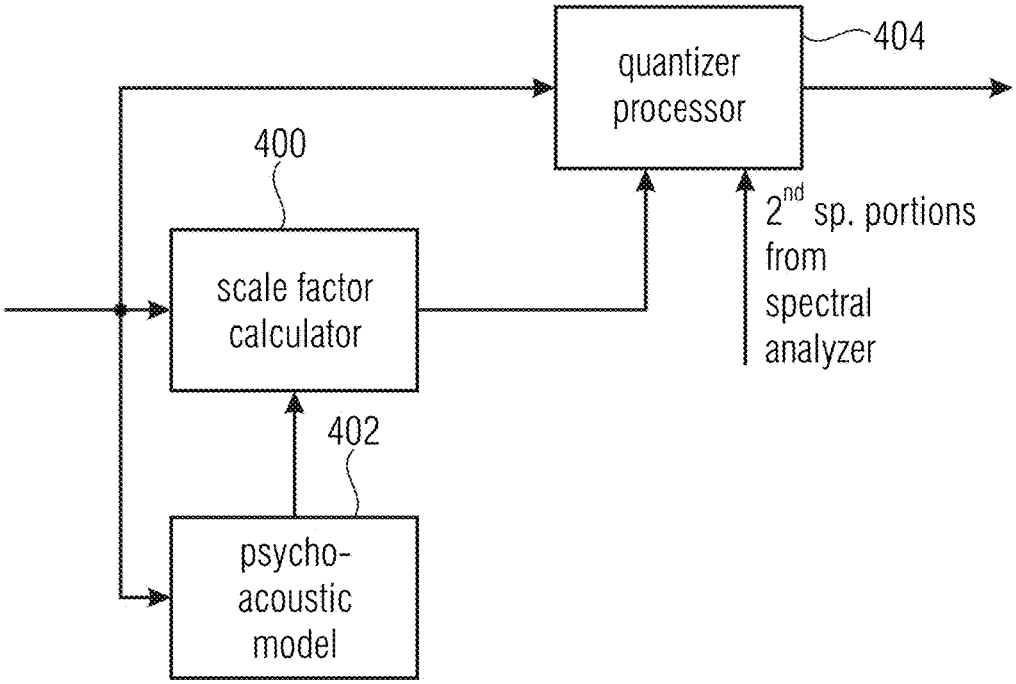
FIG. 4*a* illustrates the functionality of the spectral domain encoder for applying the selection of spectral portions into the first and second sets of spectral portions.

Advantageously, the spectral domain encoder 106 of FIG. 1*a* is a psycho-acoustically driven encoder as illustrated in FIG. 4*a*. Typically, as for example illustrated in the MPEG2/4 AAC standard or MPEG1/2, Layer 3 standard, the to be encoded audio signal after having been transformed into the spectral range (401 in FIG. 4*a*) is forwarded to a scale factor calculator 400. The scale factor calculator is controlled by a psycho-acoustic model additionally receiving the to be quantized audio signal or receiving, as in the MPEG1/2 Layer 3 or MPEG AAC standard, a complex spectral representation of the audio signal. The psycho-acoustic model calculates, for each scale factor band, a scale factor representing the psycho-acoustic threshold. Additionally, the scale factors are then, by cooperation of the well-known inner and outer iteration loops or by any other suitable encoding procedure adjusted so that certain bitrate conditions are fulfilled. Then, the to be quantized spectral values on the one hand and the calculated scale factors on the other hand are input into a quantizer processor 404. In the straightforward audio encoder operation, the to be quantized spectral values are weighted by the scale factors and, the weighted spectral values are then input into a fixed quantizer typically having a compression functionality to upper amplitude ranges. Then, at the output of the quantizer processor there do exist quantization indices which are then forwarded into an entropy encoder typically having specific and very efficient coding for a set of zero-quantization indices for adjacent frequency values or, as also called in the art, a "run" of zero values.

In the audio encoder of FIG. 1*a*, however, the quantizer processor typically receives information on the second spectral portions from the spectral analyzer. Thus, the quantizer processor 404 makes sure that, in the output of the quantizer processor 404, the second spectral portions as identified by the spectral analyzer 102 are zero or have a representation acknowledged by an encoder or a decoder as a zero representation which can be very efficiently coded, specifically when there exist "runs" of zero values in the spectrum.

Figure 4B:
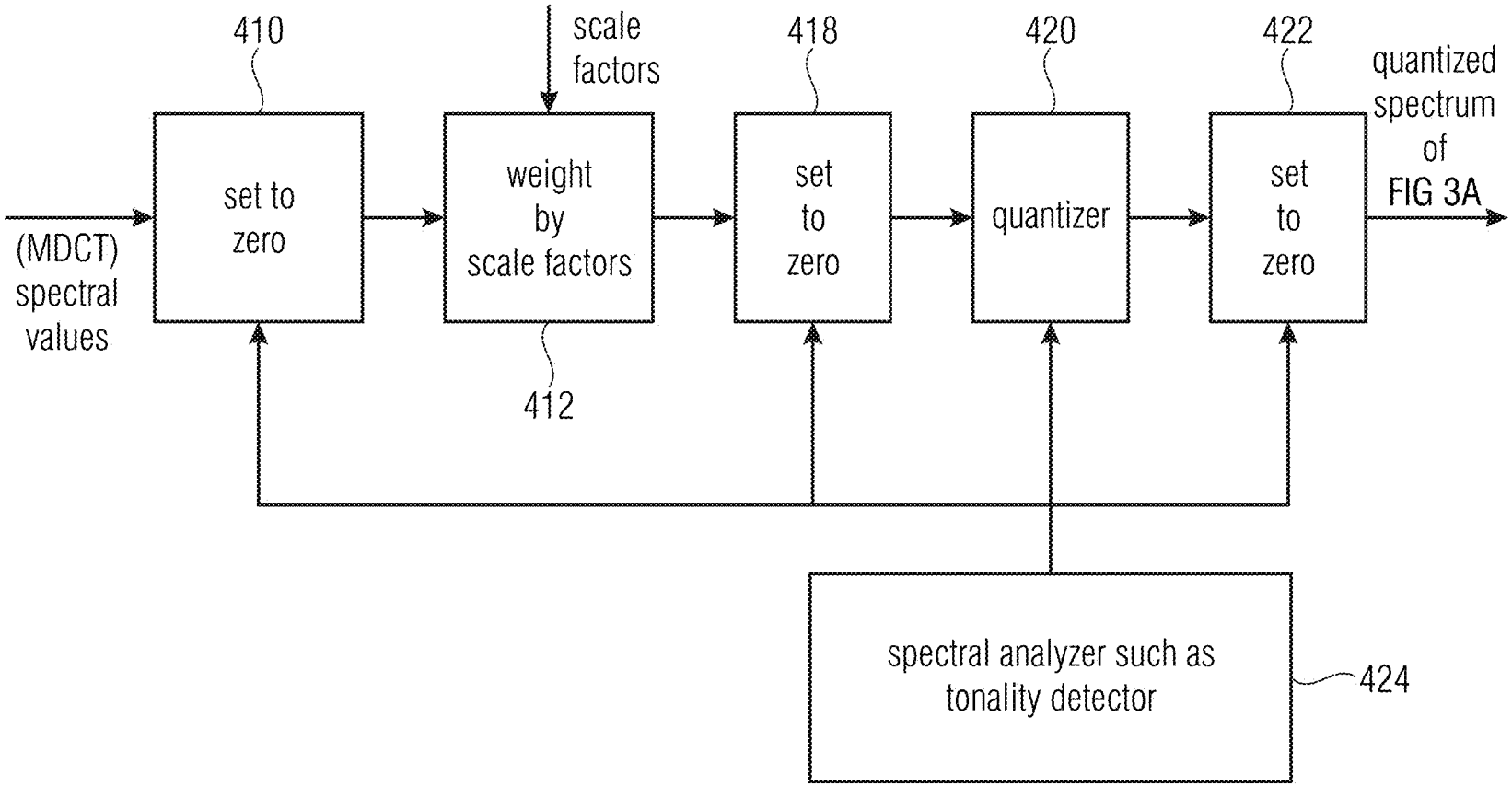
FIG. 4*b* illustrates an implementation of the functionality of FIG. 4*a;*

FIG. 4*b* illustrates an implementation of the quantizer processor. The MDCT spectral values can be input into a set to zero block 410. Then, the second spectral portions are already set to zero before a weighting by the scale factors in block 412 is performed. In an additional implementation, block 410 is not provided, but the set to zero cooperation is performed in block 418 subsequent to the weighting block 412. In an even further implementation, the set to zero operation can also be performed in a set to zero block 422 subsequent to a quantization in the quantizer block 420. In this implementation, blocks 410 and 418 would not be present. Generally, at least one of the blocks 410, 418, 422 are provided depending on the specific implementation.

Then, at the output of block 422, a quantized spectrum is obtained corresponding to what is illustrated in FIG. 3*a*. This quantized spectrum is then input into an entropy coder such as 232 in FIG. 2*b* which can be a Huffman coder or an arithmetic coder as, for example, defined in the USAC standard.

The set to zero blocks 410, 418, 422, which are provided alternatively to each other or in parallel are controlled by the spectral analyzer 424. The spectral analyzer advantageously comprises any implementation of a well-known tonality detector or comprises any different kind of detector operative for separating a spectrum into components to be encoded with a high resolution and components to be encoded with a low resolution. Other such algorithms implemented in the spectral analyzer can be a voice activity detector, a noise detector, a speech detector or any other detector deciding, depending on spectral information or associated metadata on the resolution requirements for different spectral portions.

Figure 5A:
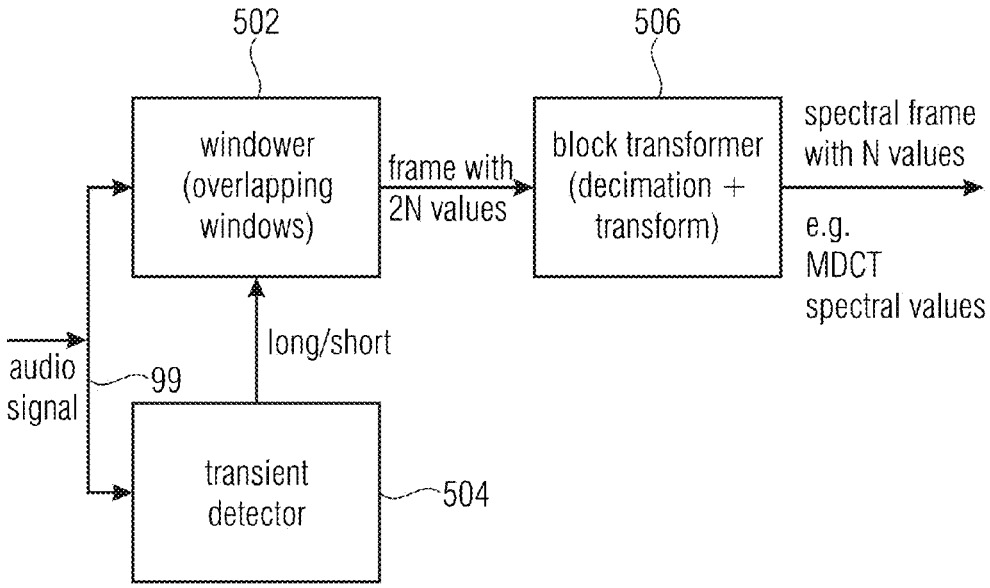
FIG. 5*a* illustrates a functionality of an MDCT encoder.

FIG. 5*a* illustrates an advantageous implementation of the time spectrum converter 100 of FIG. 1*a* as, for example, implemented in AAC or USAC. The time spectrum converter 100 comprises a windower 502 controlled by a transient detector 504. When the transient detector 504 detects a transient, then a switchover from long windows to short windows is signaled to the windower. The windower 502 then calculates, for overlapping blocks, windowed frames, where each windowed frame typically has two N values such as 2048 values. Then, a transformation within a block transformer 506 is performed, and this block transformer typically additionally provides a decimation, so that a combined decimation/transform is performed to obtain a spectral frame with N values such as MDCT spectral values. Thus, for a long window operation, the frame at the input of block 506 comprises two N values such as 2048 values and a spectral frame then has 1024 values. Then, however, a switch is performed to short blocks, when eight short blocks are performed where each short block has ⅛ windowed time domain values compared to a long window and each spectral block has ⅛ spectral values compared to a long block. Thus, when this decimation is combined with a 50% overlap operation of the windower, the spectrum is a critically sampled version of the time domain audio signal 99.

Figure 5B:
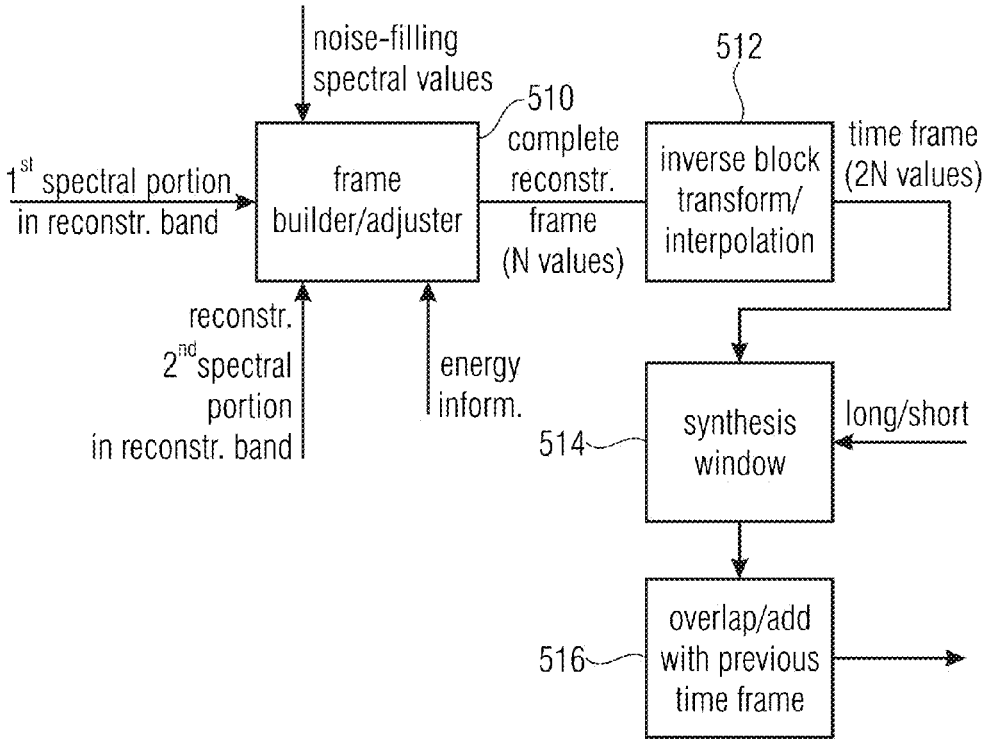
FIG. 5*b* illustrates a functionality of the decoder with an MDCT technology.

Subsequently, reference is made to FIG. 5*b* illustrating a specific implementation of frequency regenerator 116 and the spectrum-time converter 118 of FIG. 1*b*, or of the combined operation of blocks 208, 212 of FIG. 2*a*. In FIG. 5*b*, a specific reconstruction band is considered such as scale factor band 6 of FIG. 3*a*. The first spectral portion in this reconstruction band, i.e., the first spectral portion 306 of FIG. 3*a* is input into the frame builder/adjustor block 510. Furthermore, a reconstructed second spectral portion for the scale factor band 6 is input into the frame builder/adjuster 510 as well. Furthermore, energy information such as $E_3$ of FIG. 3*b* for a scale factor band 6 is also input into block 510. The reconstructed second spectral portion in the reconstruction band has already been generated by frequency tile filling using a source range and the reconstruction band then corresponds to the target range. Now, an energy adjustment of the frame is performed to then finally obtain the complete reconstructed frame having the N values as, for example, obtained at the output of combiner 208 of FIG. 2*a*. Then, in block 512, an inverse block transform/interpolation is performed to obtain 248 time domain values for the for example 124 spectral values at the input of block 512. Then, a synthesis windowing operation is performed in block 514 which is again controlled by a long window/short window indication transmitted as side information in the encoded audio signal. Then, in block 516, an overlap/add operation with a previous time frame is performed. Advantageously, MDCT applies a 50% overlap so that, for each new time frame of 2N values, N time domain values are finally output. A 50% overlap is highly advantageous due to the fact that it provides critical sampling and a continuous crossover from one frame to the next frame due to the overlap/add operation in block 516.

As illustrated at 301 in FIG. 3*a*, a noise-filling operation can additionally be applied not only below the IGF start frequency, but also above the IGF start frequency such as for the contemplated reconstruction band coinciding with scale factor band 6 of FIG. 3*a*. Then, noise-filling spectral values can also be input into the frame builder/adjuster 510 and the adjustment of the noise-filling spectral values can also be applied within this block or the noise-filling spectral values can already be adjusted using the noise-filling energy before being input into the frame builder/adjuster 510.

Advantageously, an IGF operation, i.e., a frequency tile filling operation using spectral values from other portions can be applied in the complete spectrum. Thus, a spectral tile filling operation can not only be applied in the high band above an IGF start frequency but can also be applied in the low band. Furthermore, the noise-filling without frequency tile filling can also be applied not only below the IGF start frequency but also above the IGF start frequency. It has, however, been found that high quality and high efficient audio encoding can be obtained when the noise-filling operation is limited to the frequency range below the IGF start frequency and when the frequency tile filling operation is restricted to the frequency range above the IGF start frequency as illustrated in FIG. 3*a*.

Advantageously, the target tiles (TT) (having frequencies greater than the IGF start frequency) are bound to scale factor band borders of the full rate coder. Source tiles (ST), from which information is taken, i.e., for frequencies lower than the IGF start frequency are not bound by scale factor band borders. The size of the ST should correspond to the size of the associated TT. This is illustrated using the following example. TT[0] has a length of 10 MDCT Bins. This exactly corresponds to the length of two subsequent SCBs (such as 4+6). Then, all possible ST that are to be correlated with TT[0], have a length of 10 bins, too. A second target tile TT[1] being adjacent to TT[0] has a length of 15 bins I (SCB having a length of 7+8). Then, the ST for that have a length of 15 bins rather than 10 bins as for TT[0].

Should the case arise that one cannot find a TT for an ST with the length of the target tile (when e.g. the length of TT is greater than the available source range), then a correlation is not calculated and the source range is copied a number of times into this TT (the copying is done one after the other so that a frequency line for the lowest frequency of the second copy immediately follows—in frequency—the frequency line for the highest frequency of the first copy), until the target tile TT is completely filled up.

Figure 5C:
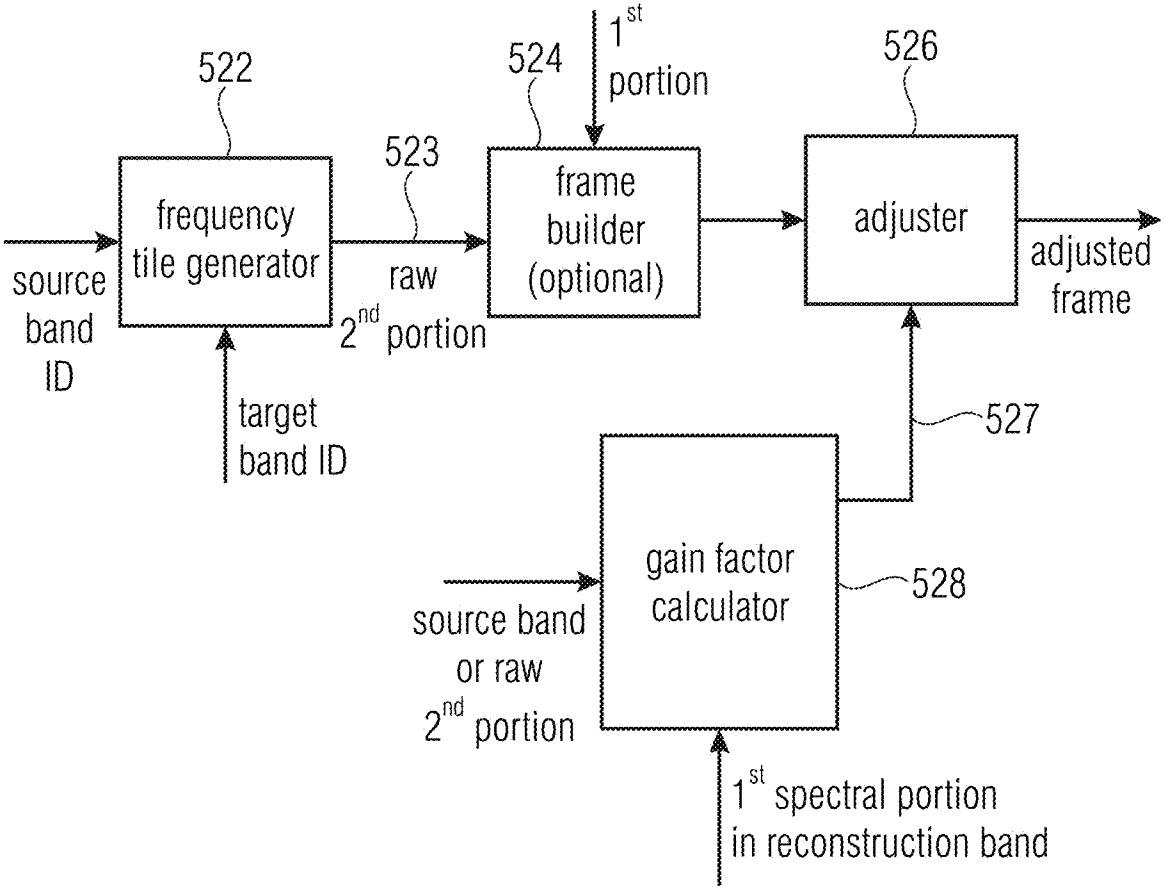
FIG. 5*c* illustrates an implementation of the frequency regenerator.

Subsequently, reference is made to FIG. 5*c* illustrating a further advantageous embodiment of the frequency regenerator 116 of FIG. 1*b* or the IGF block 202 of FIG. 2*a*. Block 522 is a frequency tile generator receiving, not only a target band ID, but additionally receiving a source band ID. Exemplarily, it has been determined on the encoder-side that the scale factor band 3 of FIG. 3*a* is very well suited for reconstructing scale factor band 7. Thus, the source band ID would be 2 and the target band ID would be 7. Based on this information, the frequency tile generator 522 applies a copy up or harmonic tile filling operation or any other tile filling operation to generate the raw second portion of spectral components 523. The raw second portion of spectral components has a frequency resolution identical to the frequency resolution included in the first set of first spectral portions.

Then, the first spectral portion of the reconstruction band such as 307 of FIG. 3*a* is input into a frame builder 524 and the raw second portion 523 is also input into the frame builder 524. Then, the reconstructed frame is adjusted by the adjuster 526 using a gain factor for the reconstruction band calculated by the gain factor calculator 528. Importantly, however, the first spectral portion in the frame is not influenced by the adjuster 526, but only the raw second portion for the reconstruction frame is influenced by the adjuster 526. To this end, the gain factor calculator 528 analyzes the source band or the raw second portion 523 and additionally analyzes the first spectral portion in the reconstruction band to finally find the correct gain factor 527 so that the energy of the adjusted frame output by the adjuster 526 has the energy $E_4$ when a scale factor band 7 is contemplated.

In this context, it is very important to evaluate the high frequency reconstruction accuracy of the present invention compared to HE-AAC. This is explained with respect to scale factor band 7 in FIG. 3*a*. It is assumed that a conventional-technology encoder such as illustrated in FIG. 13*a* would detect the spectral portion 307 to be encoded with a high resolution as a "missing harmonics". Then, the energy of this spectral component would be transmitted together with a spectral envelope information for the reconstruction band such as scale factor band 7 to the decoder. Then, the decoder would recreate the missing harmonic. However, the spectral value, at which the missing harmonic 307 would be reconstructed by the conventional-technology decoder of FIG. 13*b* would be in the middle of band 7 at a frequency indicated by reconstruction frequency 390. Thus, the present invention avoids a frequency error 391 which would be introduced by the conventional-technology decoder of FIG. 13*d*.

In an implementation, the spectral analyzer is also implemented to calculating similarities between first spectral portions and second spectral portions and to determine, based on the calculated similarities, for a second spectral portion in a reconstruction range a first spectral portion matching with the second spectral portion as far as possible. Then, in this variable source range/destination range implementation, the parametric coder will additionally introduce into the second encoded representation a matching information indicating for each destination range a matching source range. On the decoder-side, this information would then be used by a frequency tile generator 522 of FIG. 5*c* illustrating a generation of a raw second portion 523 based on a source band ID and a target band ID.

Furthermore, as illustrated in FIG. 3*a*, the spectral analyzer is configured to analyze the spectral representation up to a maximum analysis frequency being only a small amount below half of the sampling frequency and advantageously being at least one quarter of the sampling frequency or typically higher.

As illustrated, the encoder operates without downsampling and the decoder operates without upsampling. In other words, the spectral domain audio coder is configured to generate a spectral representation having a Nyquist frequency defined by the sampling rate of the originally input audio signal.

Furthermore, as illustrated in FIG. 3*a*, the spectral analyzer is configured to analyze the spectral representation starting with a gap filling start frequency and ending with a maximum frequency represented by a maximum frequency included in the spectral representation, wherein a spectral portion extending from a minimum frequency up to the gap filling start frequency belongs to the first set of spectral portions and wherein a further spectral portion such as 304, 305, 306, 307 having frequency values above the gap filling frequency additionally is included in the first set of first spectral portions.

As outlined, the spectral domain audio decoder 112 is configured so that a maximum frequency represented by a spectral value in the first decoded representation is equal to a maximum frequency included in the time representation having the sampling rate wherein the spectral value for the maximum frequency in the first set of first spectral portions is zero or different from zero. Anyway, for this maximum frequency in the first set of spectral components a scale factor for the scale factor band exists, which is generated and transmitted irrespective of whether all spectral values in this scale factor band are set to zero or not as discussed in the context of FIGS. 3*a* and 3*b*.

The invention is, therefore, advantageous that with respect to other parametric techniques to increase compression efficiency, e.g. noise substitution and noise filling (these techniques are exclusively for efficient representation of noise like local signal content) the invention allows an accurate frequency reproduction of tonal components. To date, no state-of-the-art technique addresses the efficient parametric representation of arbitrary signal content by spectral gap filling without the restriction of a fixed a-priory division in low band (LF) and high band (HF).

Embodiments of the inventive system improve the state-of-the-art approaches and thereby provides high compression efficiency, no or only a small perceptual annoyance and full audio bandwidth even for low bitrates.

The general system consists of full band core coding intelligent gap filling (tile filling or noise filling)

sparse tonal parts in core selected by tonal mask joint stereo pair coding for full band, including tile filling TNS on tile spectral whitening in IGF range A first step towards a more efficient system is to remove the need for transforming spectral data into a second transform domain different from the one of the core coder. As the majority of audio codecs, such as AAC for instance, use the MDCT as basic transform, it is useful to perform the BWE in the MDCT domain also. A second requirement for the BWE system would be the need to preserve the tonal grid whereby even HF tonal components are preserved and the quality of the coded audio is thus superior to the existing systems. To take care of both the above mentioned requirements for a BWE scheme, a new system is proposed called Intelligent Gap Filling (IGF). FIG. 2*b* shows the block diagram of the proposed system on the encoder-side and FIG. 2*a* shows the system on the decoder-side.

Figure 9A:
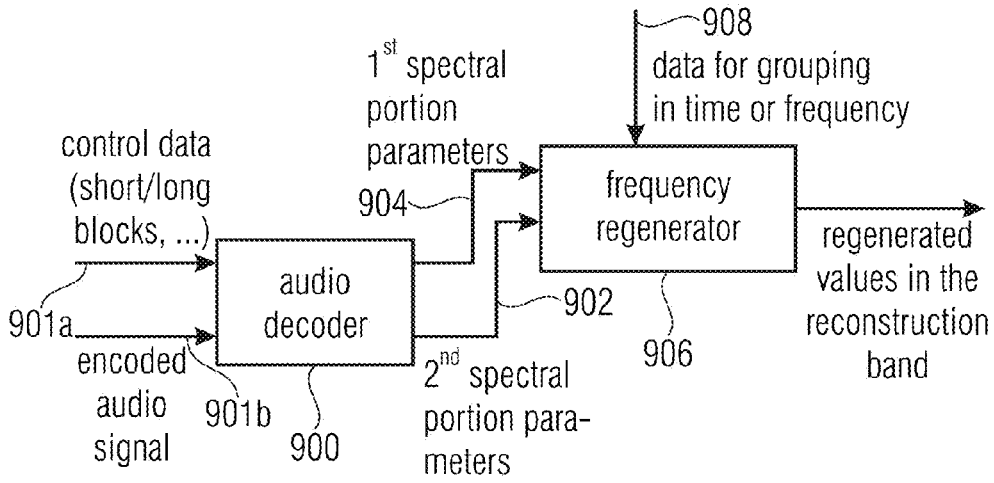
FIG. 9*a* illustrates a decoder with frequency regeneration technology using energy values for the regeneration frequency range.
Figure 9B:
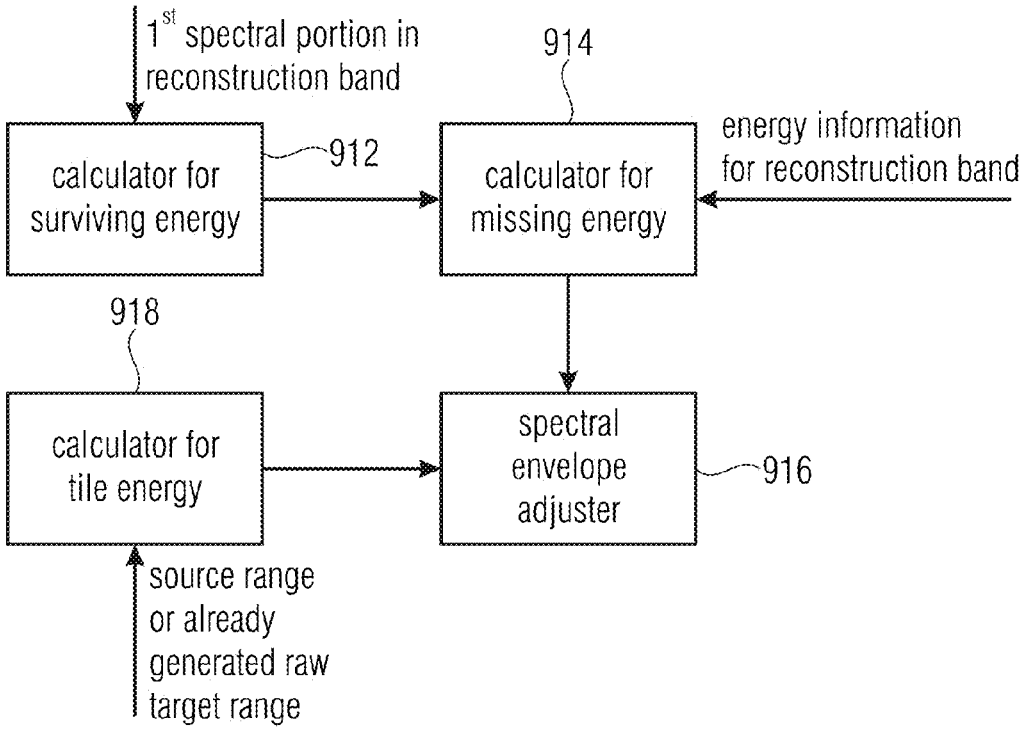
FIG. 9*b* illustrates a more detailed implementation of the frequency regenerator of FIG. 9*a;*

FIG. 9*a* illustrates an apparatus for decoding an encoded audio signal comprising an encoded representation of a first set of first spectral portions and an encoded representation of parametric data indicating spectral energies for a second set of second spectral portions. The first set of first spectral portions is indicated at 901*a* in FIG. 9*a*, and the encoded representation of the parametric data is indicated at 901*b* in FIG. 9*a*. An audio decoder 900 is provided for decoding the encoded representation 901*a* of the first set of first spectral portions to obtain a decoded first set of first spectral portions 904 and for decoding the encoded representation of the parametric data to obtain a decoded parametric data 902 for the second set of second spectral portions indicating individual energies for individual reconstruction bands, where the second spectral portions are located in the reconstruction bands. Furthermore, a frequency regenerator 906 is provided for reconstructing spectral values of a reconstruction band comprising a second spectral portion. The frequency regenerator 906 uses a first spectral portion of the first set of first spectral portions and an individual energy information for the reconstruction band, where the reconstruction band comprises a first spectral portion and the second spectral portion. The frequency regenerator 906 comprises a calculator 912 for determining a survive energy information comprising an accumulated energy of the first spectral portion having frequencies in the reconstruction band. Furthermore, the frequency regenerator 906 comprises a calculator 918 for determining a tile energy information of further spectral portions of the reconstruction band and for frequency values being different from the first spectral portion, where these frequency values have frequencies in the reconstruction band, wherein the further spectral portions are to be generated by frequency regeneration using a first spectral portion different from the first spectral portion in the reconstruction band.

The frequency regenerator 906 further comprises a calculator 914 for a missing energy in the reconstruction band, and the calculator 914 operates using the individual energy for the reconstruction band and the survive energy generated by block 912. Furthermore, the frequency regenerator 906 comprises a spectral envelope adjuster 916 for adjusting the further spectral portions in the reconstruction band based on the missing energy information and the tile energy information generated by block 918.

Reference is made to FIG. 9*c* illustrating a certain reconstruction band 920. The reconstruction band comprises a first spectral portion in the reconstruction band such as the first spectral portion 306 in FIG. 3*a* schematically illustrated at 921. Furthermore, the rest of the spectral values in the reconstruction band 920 are to be generated using a source region, for example, from the scale factor band 1, 2, 3 below the intelligent gap filling start frequency 309 of FIG. 3*a*. The frequency regenerator 906 is configured for generating raw spectral values for the second spectral portions 922 and 923. Then, a gain factor g is calculated as illustrated in FIG. 9*c* in order to finally adjust the raw spectral values in frequency bands 922, 923 in order to obtain the reconstructed and adjusted second spectral portions in the reconstruction band 920 which now have the same spectral resolution, i.e., the same line distance as the first spectral portion 921. It is important to understand that the first spectral portion in the reconstruction band illustrated at 921 in FIG. 9*c* is decoded by the audio decoder 900 and is not influenced by the envelope adjustment performed block 916 of FIG. 9*b*. Instead, the first spectral portion in the reconstruction band indicated at 921 is left as it is, since this first spectral portion is output by the full bandwidth or full rate audio decoder 900 via line 904.

Subsequently, a certain example with real numbers is discussed. The remaining survive energy as calculated by block 912 is, for example, five energy units and this energy is the energy of the exemplarily indicated four spectral lines in the first spectral portion 921.

Furthermore, the energy value E3 for the reconstruction band corresponding to scale factor band 6 of FIG. 3*b* or FIG. 3*a* is equal to 10 units. Importantly, the energy value not only comprises the energy of the spectral portions 922, 923, but the full energy of the reconstruction band 920 as calculated on the encoder-side, i.e., before performing the spectral analysis using, for example, the tonality mask. Therefore, the ten energy units cover the first and the second spectral portions in the reconstruction band. Then, it is assumed that the energy of the source range data for blocks 922, 923 or for the raw target range data for block 922, 923 is equal to eight energy units. Thus, a missing energy of five units is calculated.

Based on the missing energy divided by the tile energy tEk, a gain factor of 0.79 is calculated. Then, the raw spectral lines for the second spectral portions 922, 923 are multiplied by the calculated gain factor. Thus, only the spectral values for the second spectral portions 922, 923 are adjusted and the spectral lines for the first spectral portion 921 are not influenced by this envelope adjustment. Subsequent to multiplying the raw spectral values for the second spectral portions 922, 923, a complete reconstruction band has been calculated consisting of the first spectral portions in the reconstruction band, and consisting of spectral lines in the second spectral portions 922, 923 in the reconstruction band 920.

Advantageously, the source range for generating the raw spectral data in bands 922, 923 is, with respect to frequency, below the IGF start frequency 309 and the reconstruction band 920 is above the IGF start frequency 309.

Furthermore, it is advantageous that reconstruction band borders coincide with scale factor band borders. Thus, a reconstruction band has, in one embodiment, the size of corresponding scale factor bands of the core audio decoder or are sized so that, when energy pairing is applied, an energy value for a reconstruction band provides the energy of two or a higher integer number of scale factor bands. Thus, when is assumed that energy accumulation is performed for scale factor band 4, scale factor band 5 and scale factor band 6, then the lower frequency border of the reconstruction band 920 is equal to the lower border of scale factor band 4 and the higher frequency border of the reconstruction band 920 coincides with the higher border of scale factor band 6.

Figure 9D:
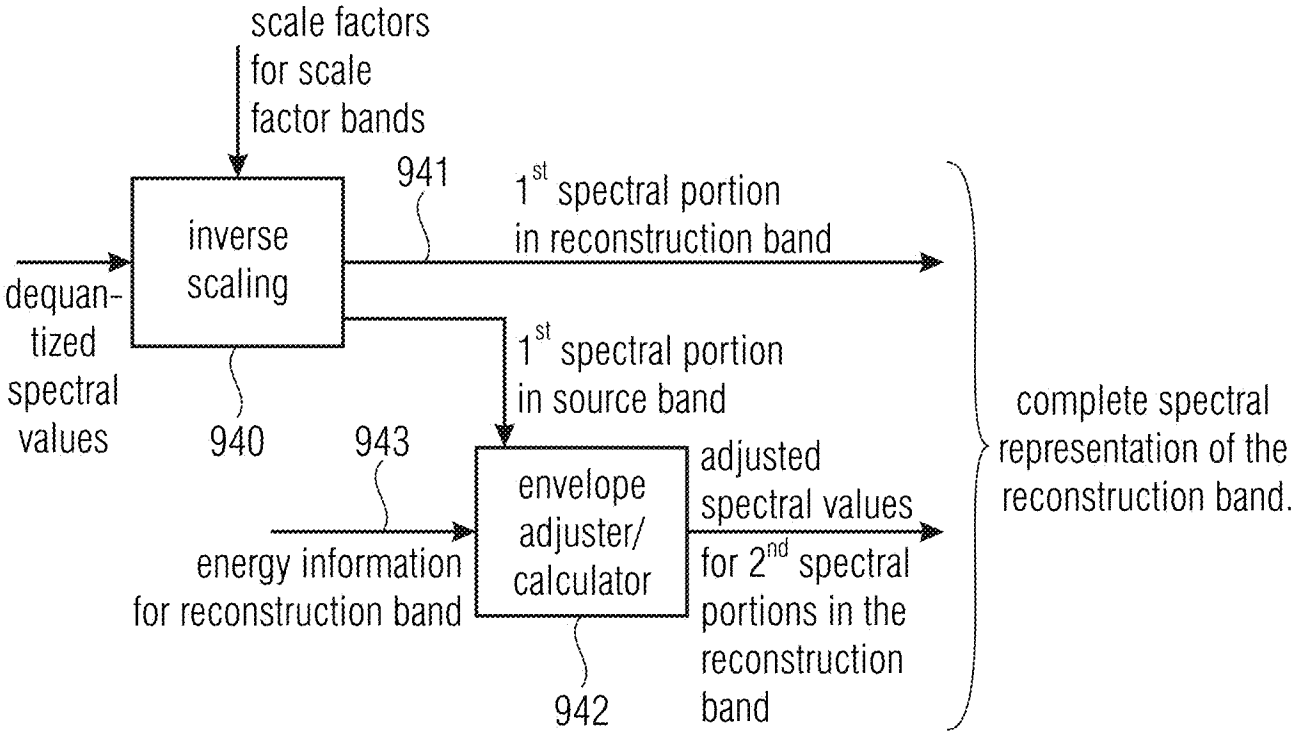
FIG. 9*d* illustrates a further implementation of the decoder of FIG. 9*a;*

Subsequently, FIG. 9*d* is discussed in order to show further functionalities of the decoder of FIG. 9*a*. The audio decoder 900 receives the dequantized spectral values corresponding to first spectral portions of the first set of spectral portions and, additionally, scale factors for scale factor bands such as illustrated in FIG. 3*b* are provided to an inverse scaling block 940. The inverse scaling block 940 provides all first sets of first spectral portions below the IGF start frequency 309 of FIG. 3*a* and, additionally, the first spectral portions above the IGF start frequency, i.e., the first spectral portions 304, 305, 306, 307 of FIG. 3*a* which are all located in a reconstruction band as illustrated at 941 in FIG. 9*d*. Furthermore, the first spectral portions in the source band used for frequency tile filling in the reconstruction band are provided to the envelope adjuster/calculator 942 and this block additionally receives the energy information for the reconstruction band provided as parametric side information to the encoded audio signal as illustrated at 943 in FIG. 9*d*. Then, the envelope adjuster/calculator 942 provides the functionalities of FIGS. 9*b* and 9*c* and finally outputs adjusted spectral values for the second spectral portions in the reconstruction band. These adjusted spectral values 922, 923 for the second spectral portions in the reconstruction band and the first spectral portions 921 in the reconstruction band indicated that line 941 in FIG. 9*d* jointly represent the complete spectral representation of the reconstruction band.

Subsequently, reference is made to FIGS. 10*a* to 10*b* for explaining advantageous embodiments of an audio encoder for encoding an audio signal to provide or generate an encoded audio signal. The encoder comprises a time/spectrum converter 1002 feeding a spectral analyzer 1004, and the spectral analyzer 1004 is connected to a parameter calculator 1006 on the one hand and an audio encoder 1008 on the other hand. The audio encoder 1008 provides the encoded representation of a first set of first spectral portions and does not cover the second set of second spectral portions. On the other hand, the parameter calculator 1006 provides energy information for a reconstruction band covering the first and second spectral portions. Furthermore, the audio encoder 1008 is configured for generating a first encoded representation of the first set of first spectral portions having the first spectral resolution, where the audio encoder 1008 provides scale factors for all bands of the spectral representation generated by block 1002. Additionally, as illustrated in FIG. 3*b*, the encoder provides energy information at least for reconstruction bands located, with respect to frequency, above the IGF start frequency 309 as illustrated in FIG. 3*a*. Thus, for reconstruction bands advantageously coinciding with scale factor bands or with groups of scale factor bands, two values are given, i.e., the corresponding scale factor from the audio encoder 1008 and, additionally, the energy information output by the parameter calculator 1006.

The audio encoder advantageously has scale factor bands with different frequency bandwidths, i.e., with a different number of spectral values. Therefore, the parametric calculator comprise a normalizer 1012 for normalizing the energies for the different bandwidth with respect to the bandwidth of the specific reconstruction band. To this end, the normalizer 1012 receives, as inputs, an energy in the band and a number of spectral values in the band and the normalizer 1012 then outputs a normalized energy per reconstruction/scale factor band.

Figure 10A:
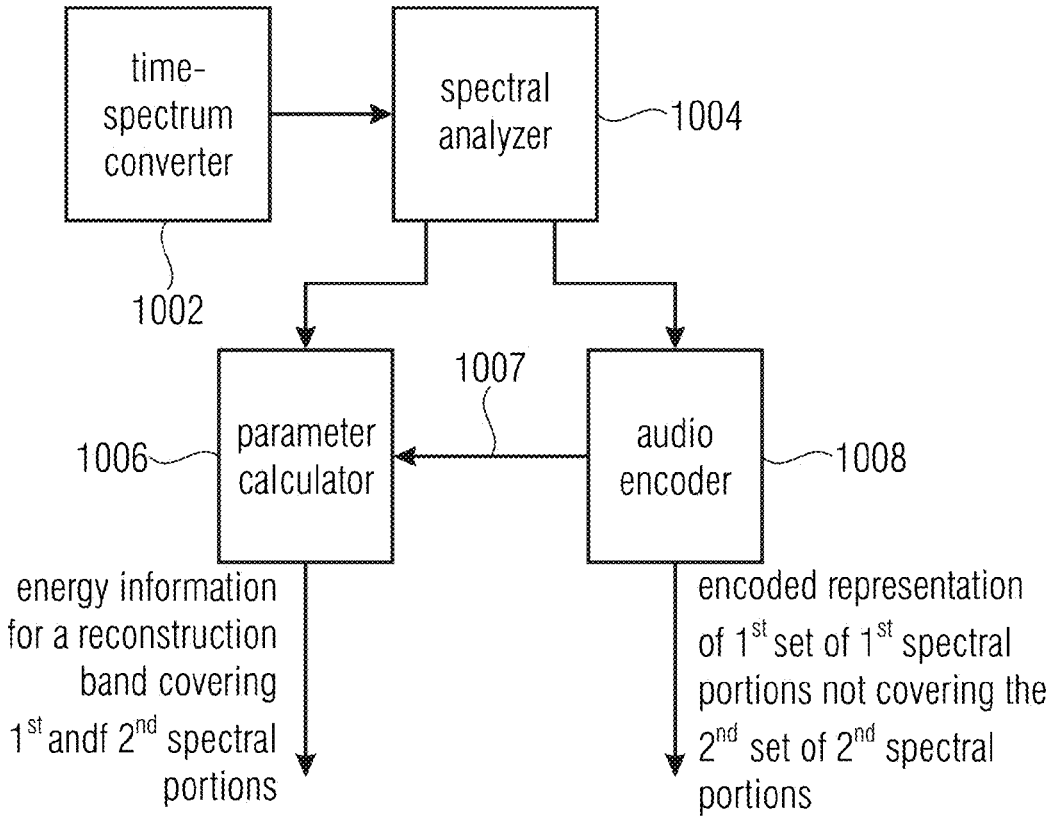
FIG. 10*a* illustrates a block diagram of an encoder matching with the decoder of FIG. 9*a;*
Figure 10B:
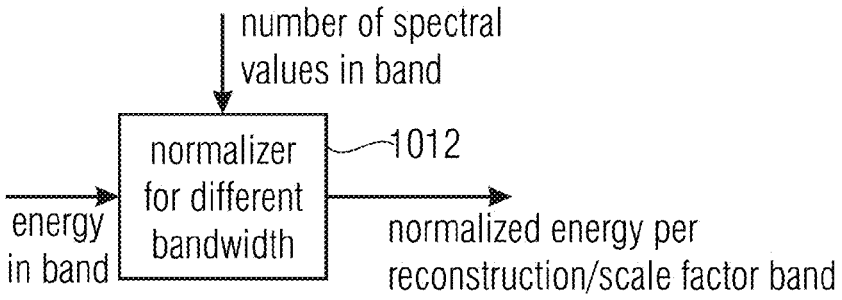
FIG. 10*b* illustrates a block diagram for illustrating a further functionality of the parameter calculator of FIG. 10*a;*
Figure 10C:
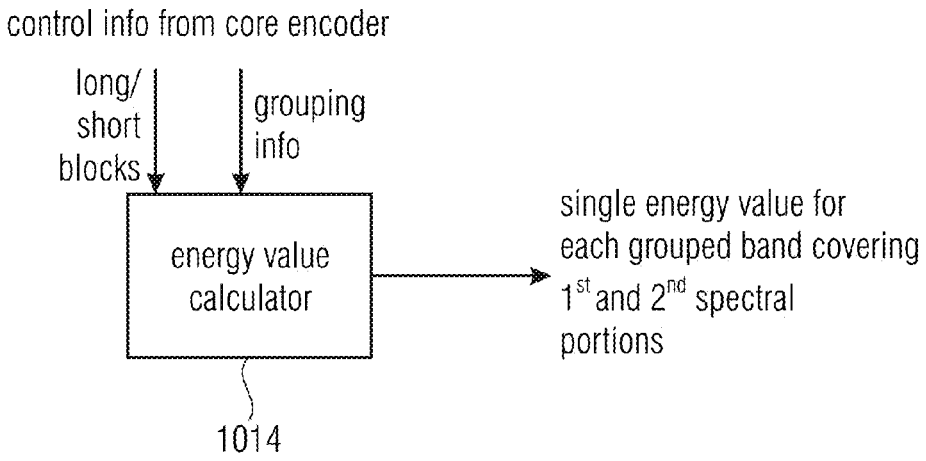
FIG. 10*c* illustrates a block diagram illustrating a further functionality of the parametric calculator of FIG. 10*a;*

Furthermore, the parametric calculator 1006*a* of FIG. 10*a* comprises an energy value calculator receiving control information from the core or audio encoder 1008 as illustrated by line 1007 in FIG. 10*a*. This control information may comprise information on long/short blocks used by the audio encoder and/or grouping information. Hence, while the information on long/short blocks and grouping information on short windows relate to a "time" grouping, the grouping information may additionally refer to a spectral grouping, i.e., the grouping of two scale factor bands into a single reconstruction band. Hence, the energy value calculator 1014 outputs a single energy value for each grouped band covering a first and a second spectral portion when only the spectral portions have been grouped.

Figure 10D:
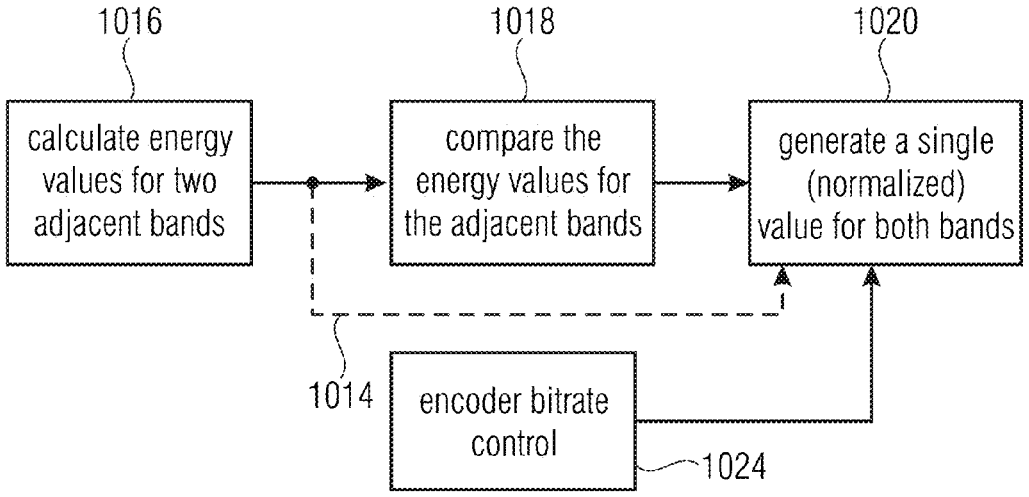
FIG. 10*d* illustrates a block diagram illustrating a further functionality of the parametric calculator of FIG. 10*a;*

FIG. 10*d* illustrates a further embodiment for implementing the spectral grouping. To this end, block 1016 is configured for calculating energy values for two adjacent bands. Then, in block 1018, the energy values for the adjacent bands are compared and, when the energy values are not so much different or less different than defined by, for example, a threshold, then a single (normalized) value for both bands is generated as indicated in block 1020. As illustrated by line 1019, the block 1018 can be bypassed. Furthermore, the generation of a single value for two or more bands performed by block 1020 can be controlled by an encoder bitrate control 1024. Thus, when the bitrate is to be reduced, the encoded bitrate control 1024 controls block 1020 to generate a single normalized value for two or more bands even though the comparison in block 1018 would not have been allowed to group the energy information values.

In case the audio encoder is performing the grouping of two or more short windows, this grouping is applied for the energy information as well. When the core encoder performs a grouping of two or more short blocks, then, for these two or more blocks, only a single set of scale factors is calculated and transmitted. On the decoder-side, the audio decoder then applies the same set of scale factors for both grouped windows.

Regarding the energy information calculation, the spectral values in the reconstruction band are accumulated over two or more short windows. In other words, this means that the spectral values in a certain reconstruction band for a short block and for the subsequent short block are accumulated together and only single energy information value is transmitted for this reconstruction band covering two short blocks. Then, on the decoder-side, the envelope adjustment discussed with respect to FIGS. 9*a* to 9*d* is not performed individually for each short block but is performed together for the set of grouped short windows.

The corresponding normalization is then again applied so that even though any grouping in frequency or grouping in time has been performed, the normalization easily allows that, for the energy value information calculation on the decoder-side, only the energy information value on the one hand and the amount of spectral lines in the reconstruction band or in the set of grouped reconstruction bands has to be known.

Furthermore, it is emphasized that an information on spectral energies, an information on individual energies or an individual energy information, an information on a survive energy or a survive energy information, an information a tile energy or a tile energy information, or an information on a missing energy or a missing energy information may comprise not only an energy value, but also an (e.g. absolute) amplitude value, a level value or any other value, from which a final energy value can be derived. Hence, the information on an energy may e.g. comprise the energy value itself, and/or a value of a level and/or of an amplitude and/or of an absolute amplitude.

Figure 12A:
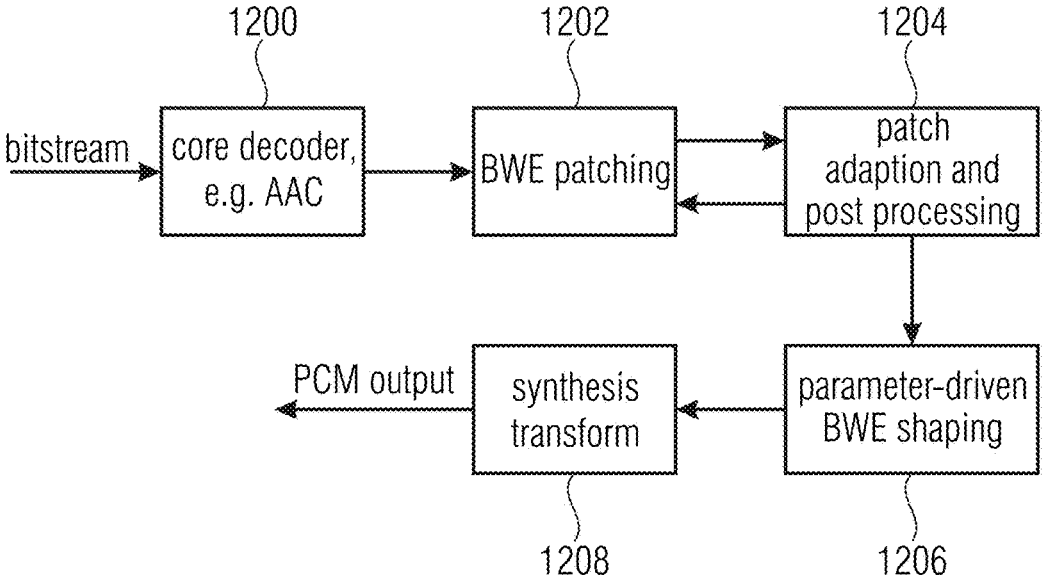
FIG. 12*a* illustrates a block diagram of an apparatus for decoding an encoded audio signal.

FIG. 12*a* illustrates a further implementation of the apparatus for decoding. A bitstream is received by a core decoder 1200 which can, for example, be an AAC decoder. The result is configured into a stage for performing a bandwidth extension patching or tiling 1202 corresponding to the frequency regenerator 604 for example. Then, a procedure of patch/tile adaption and post-processing is performed, and, when a patch adaption has been performed, the frequency regenerator 1202 is controlled to perform a further frequency regeneration, but now with, for example adjusted frequency borders. Furthermore, when a patch processing is performed such as by the elimination or attenuation of tonal lines, the result is then forwarded to block 1206 performing the parameter-driven bandwidth envelope shaping as, for example, also discussed in the context of block 712 or 826. The result is then forwarded to a synthesis transform block 1208 for performing a transform into the final output domain which is, for example, a PCM output domain as illustrated in FIG. 12*a*.

Main features of embodiments of the invention are as follows:

The advantageous embodiment is based on the MDCT that exhibits the above referenced warbling artifacts if tonal spectral areas are pruned by the unfortunate choice of cross-over frequency and/or patch margins, or tonal components get to be placed in too close vicinity at patch borders.

Figure 12B:
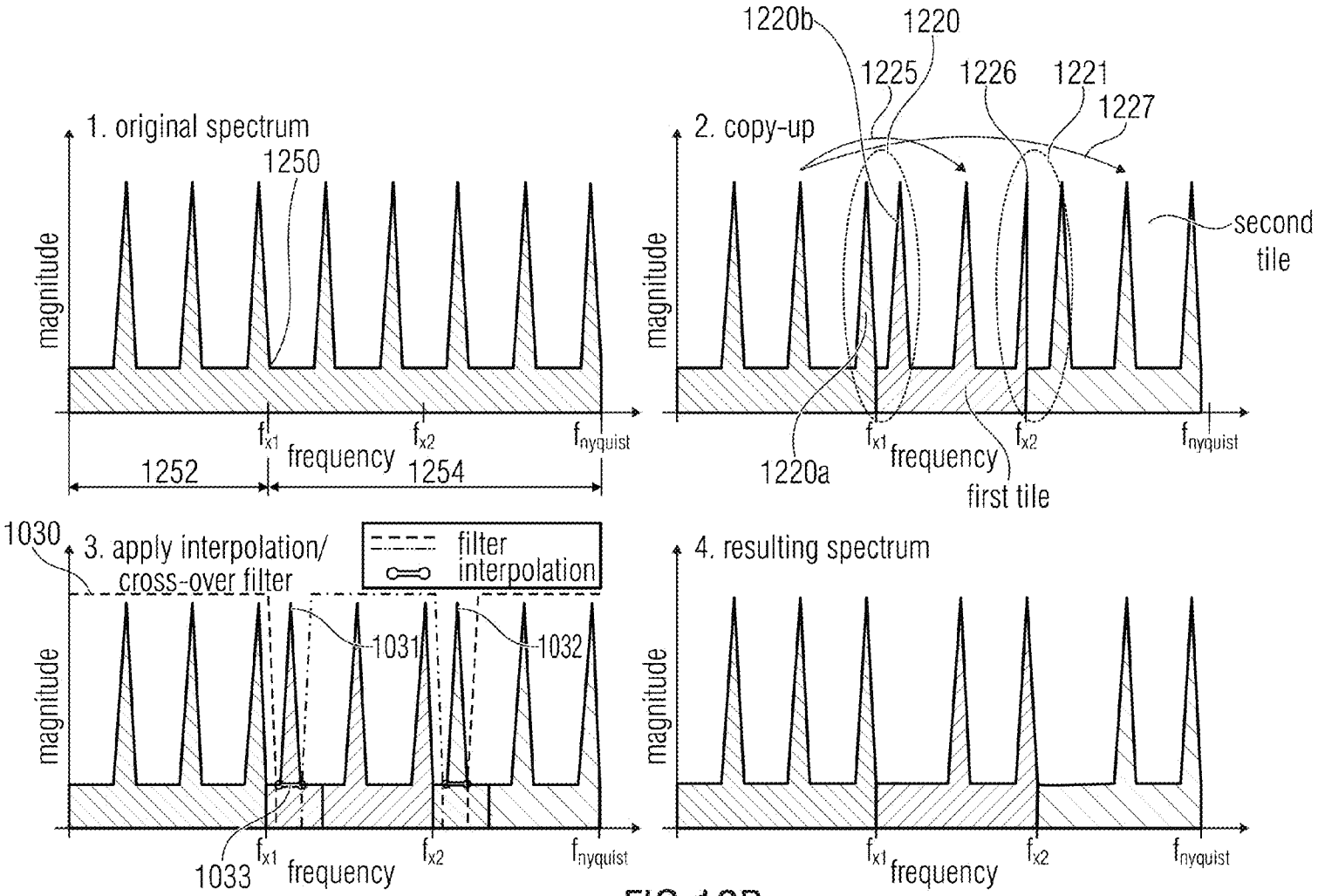
FIG. 12*b* illustrates magnitude spectra (stylized) of a tonal signal, a copy-up without patch/tile adaption, a copy-up with changed frequency borders and an additional elimination of artifact-creating tonal portions.

FIG. 12*b* shows how the newly proposed technique reduces artifacts found in state-of-the-art BWE methods. In FIG. 12 panel (2), the stylized magnitude spectrum of the output of a contemporary BWE method is shown. In this example, the signal is perceptually impaired by the beating caused by to two nearby tones, and also by the splitting of a tone. Both problematic spectral areas are marked with a circle each.

To overcome these problems, the new technique first detects the spectral location of the tonal components contained in the signal. Then, according to one aspect of the invention, it is attempted to adjust the transition frequencies between LF and all patches by individual shifts (within given limits) such that splitting or beating of tonal components is minimized. For that purpose, the transition frequency advantageously has to match a local spectral minimum. This step is shown in FIG. 12*b* panel (2) and panel (3), where the transition frequency $f_{x2}$ is shifted towards higher frequencies, resulting in $f'_{x2}$.

According to another aspect of the invention, if problematic spectral content in transition regions remains, at least one of the misplaced tonal components is removed to reduce either the beating artifact at the transition frequencies or the warbling. This is done via spectral extrapolation or interpolation/filtering, as shown in FIG. 2 panel (3). A tonal component is thereby removed from foot-point to foot-point, i.e. from its left local minimum to its right local minimum. The resulting spectrum after the application of the inventive technology is shown in FIG. 12*b* panel (4).

In other words, FIG. 12*b* illustrates, in the upper left corner, i.e., in panel (1), the original signal. In the upper right corner, i.e., in panel (2), a comparison bandwidth extended signal with problematic areas marked by ellipses 1220 and 1221 is shown. In the lower left corner, i.e., in panel (3), two advantageous patch or frequency tile processing features are illustrated. The splitting of tonal portions has been addressed by increasing the frequency border $f'_{x2}$ so that a clipping of the corresponding tonal portion is not there anymore. Furthermore, gain functions 1030 for eliminating the tonal portion 1031 and 1032 are applied or, alternatively, an interpolation illustrated by 1033 is indicated. Finally, the lower right corner of FIG. 12*b*, i.e., panel (4) depicts the improved signal resulting from a combination of tile/patch frequency adjusting on the one hand and elimination or at least attenuation of problematic tonal portions.

Panel (1) of FIG. 12*b* illustrates, as discussed before, the original spectrum, and the original spectrum has a core frequency range up to the cross-over or gap filing start frequency fx1.

Thus, a frequency $f_{x1}$ illustrates a border frequency 1250 between the source range 1252 and a reconstruction range 1254 extending between the border frequency 1250 and a maximum frequency which is smaller than or equal to the Nyquist frequency $f_{Nyquist}$. On the encoder-side, it is assumed that a signal is bandwidth-limited at $f_{x1}$ or, when the technology regarding intelligent gap filling is applied, it is assumed that $f_{x1}$ corresponds to the gap filling start frequency 309 of FIG. 3*a*. Depending on the technology, the reconstruction range above $f_{x1}$ will be empty (in case of the FIG. 13*a*, 13*b* implementation) or will comprise certain first spectral portions to be encoded with a high resolution as discussed in the context of FIG. 3*a*.

FIG. 12*b*, panel (2) illustrates a preliminary regenerated signal, for example generated by block 702 of FIG. 7*a* which has two problematic portions. One problematic portion is illustrated at 1220. the frequency distance between the tonal portion within the core region illustrated at 1220*a* and the tonal portion at the start of the frequency tile illustrated at 1220*b* is too small so that a beating artifact would be created. The further problem is that at the upper border of the first frequency tile generated by the first patching operation or frequency tiling operation illustrated at 1225 is a halfwayclipped or split tonal portion 1226. When this tonal portion 1226 is compared to the other tonal portions in FIG. 12*b*, it becomes clear that the width is smaller than the width of a typical tonal portion and this means that this tonal portion has been split by setting the frequency border between the first frequency tile 1225 and the second frequency tile 1227 at the wrong place in the source range 1252. In order to address this issue, the border frequency $f_{x2}$ has been modified to become a little bit greater as illustrated in panel (3) in FIG. 12*b*, so that a clipping of this tonal portion does not occur.

On the other hand, this procedure, in which $f'_{x2}$ has been changed does not effectively address the beating problem which, therefore, is addressed by a removal of the tonal components by filtering or interpolation or any other procedures as discussed in the context of block 708 of FIG. 7*a*. Thus, FIG. 12*b* illustrates a sequential application of the transition frequency adjustment 706 and the removal of tonal components at borders illustrated at 708.

Another option would have been to set the transition border $f_{x1}$ so that it is a little bit lower so that the tonal portion 1220*a* is not in the core range anymore. Then, the tonal portion 1220*a* has also been removed or eliminated by setting the transition frequency $f_{x1}$ at a lower value.

This procedure would also have worked for addressing the issue with the problematic tonal component 1032. By setting $f'_{x2}$ even higher, the spectral portion where the tonal portion 1032 is located could have been regenerated within the first patching operation 1225 and, therefore, two adjacent or neighboring tonal portions would not have occurred.

Basically, the beating problem depends on the amplitudes and the distance in frequency of adjacent tonal portions. The detector 704, 720 or stated more general, the analyzer 602 is advantageously configured in such a way that an analysis of the lower spectral portion located in the frequency below the transition frequency such as $f_{x1}$, $f_{x2}$, $f'_{x2}$ is analyzed in order to locate any tonal component. Furthermore, the spectral range above the transition frequency is also analyzed in order to detect a tonal component. When the detection results in two tonal components, one to the left of the transition frequency with respect to frequency and one to the right (with respect to ascending frequency), then the remover of tonal components at borders illustrated at 708 in FIG. 7*a* is activated. The detection of tonal components is performed in a certain detection range which extends, from the transition frequency, in both directions at least 20% with respect to the bandwidth of the corresponding band and advantageously only extends up to 10% downwards to the left of the transition frequency and upwards to the right of the transition frequency related to the corresponding bandwidth, i.e., the bandwidth of the source range on the one hand and the reconstruction range on the other hand or, when the transition frequency is the transition frequency between two frequency tiles 1225, 1227, a corresponding 10% amount of the corresponding frequency tile. In a further embodiment, the predetermined detection bandwidth is one Bark. It should be possible to remove tonal portions within a range of 1 Bark around a patch border, so that the complete detection range is 2 Bark, i.e., one Bark in the lower band and one Bark in the higher band, where the one Bark in the lower band is immediately adjacent to the one Bark in the higher band.

According to another aspect of the invention, to reduce the filter ringing artifact, a cross-over filter in the frequency domain is applied to two consecutive spectral regions, i.e. between the core band and the first patch or between two patches. Advantageously, the cross-over filter is signal adaptive.

The cross over filter consists of two filters, a fade-out filter $h_{out}$, which is applied to the lower spectral region, and a fade-in filter $h_{in}$, which is applied to the higher spectral region.

Each of the filters has length N.

In addition, the slope of both filters is characterized by a signal adaptive value called Xbias determining the notch characteristic of the cross-over filter, with 0≤Xbias≤N:

If Xbias=0, then the sum of both filters is equal to 1, i.e. there is no notch filter characteristic in the resulting filter.

If Xbias=N, then both filters are completely zero.

Figure 12C:
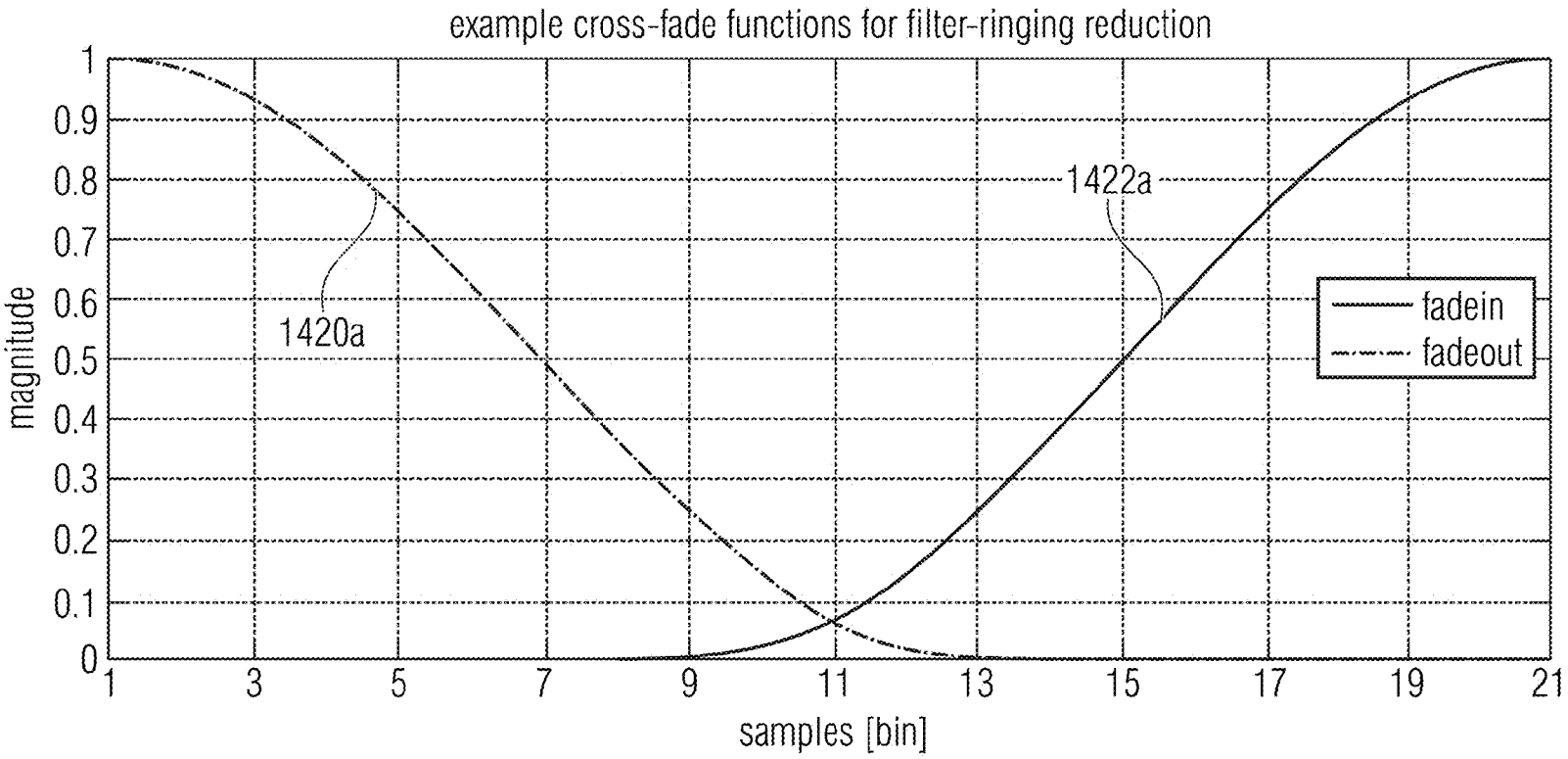
FIG. 12*c* illustrates an example cross-fade function.

The basic design of the cross-over filters is constraint to the following equations:

$$h_{out}(k)=h_{in}(N-1-k),\forall X\text{bias}$$

$$h_{out}(k)+h_{in}(k)=1,X\text{bias}=0$$

with k=0, 1, . . . , N−1 being the frequency index. FIG. 12*c* shows an example of such a cross-over filter.

In this example, the following equation is used to create the filter $h_{out}$:

$$h_{out}(k) = 0.5 + 0.5 \cdot \cos\left(\frac{k}{N-1-Xbias} \cdot \pi\right),$$
$$k = 0, 1, \ldots, N-1-Xbias$$

The following equation describes how the filters $h_{in}$ and $h_{out}$ are then applied, $$Y(k_t-(N-1)+k)=LF(k_t-(N-1)+k)\cdot h_{out}(k)+HF(k_t-(N-1)+k)\cdot h_{in}(k),k=0,1,\ldots,N-1$$

with Y denoting the assembled spectrum, $k_t$ being the transition frequency, LF being the low frequency content and HF being the high frequency content.

Next, evidence of the benefit of this technique will be presented. The original signal in the following examples is a transient-like signal, in particular a low pass filtered version thereof, with a cut-off frequency of 22 kHz. First, this transient is band limited to 6 kHz in the transform domain. Subsequently, the bandwidth of the low pass filtered original signal is extended to 24 kHz. The bandwidth extension is accomplished through copying the LF band three times to entirely fill the frequency range that is available above 6 kHz within the transform.

Figure 11A:
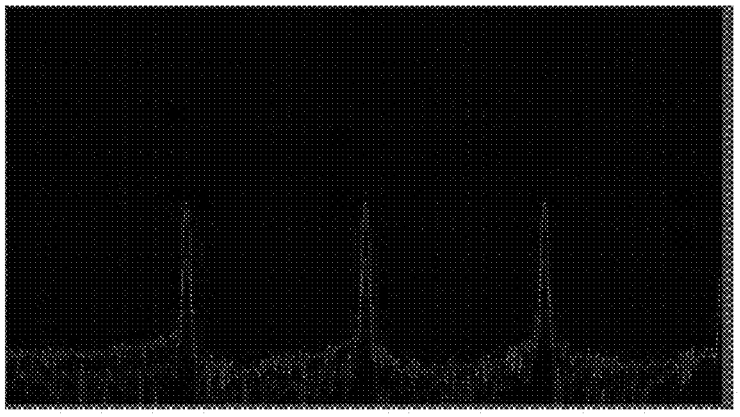
FIG. 11*a* illustrates a spectrum of a filter ringing surrounding a transient.

FIG. 11*a* shows the spectrum of this signal, which can be considered as a typical spectrum of a filter ringing artifact that spectrally surrounds the transient due to said brick-wall characteristic of the transform (speech peaks 1100). By applying the inventive approach, the filter ringing is reduced by approx. 20 dB at each transition frequency (reduced speech peaks).

Figure 11B:
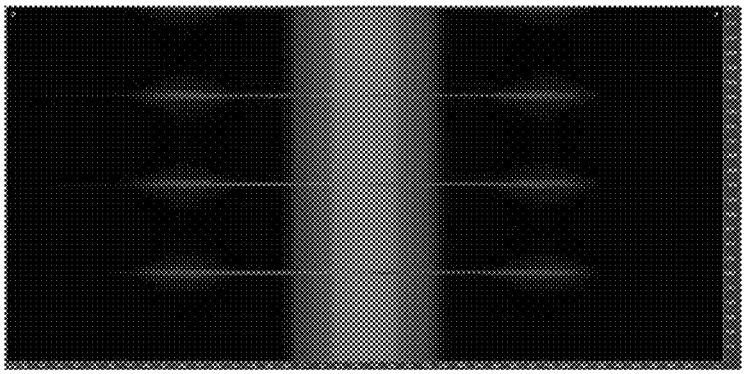
FIG. 11*b* illustrates a spectrogram of a transient after applying bandwidth extension.
Figure 11C:
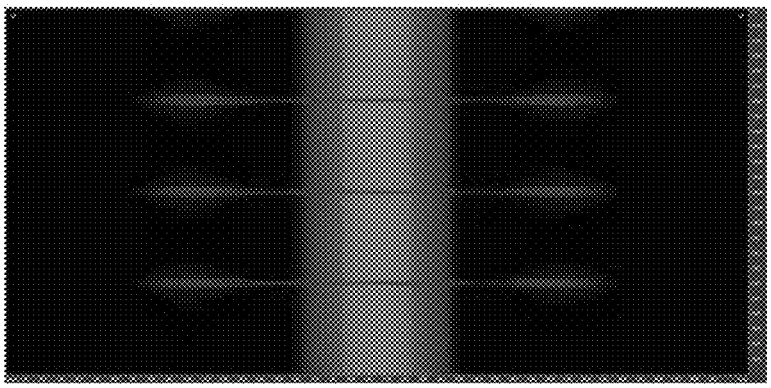
FIG. 11*c* illustrates a spectrogram of a transient after applying bandwidth extension with filter ringing reduction.

The same effect, yet in a different illustration, is shown in FIG. 11*b*, 11*c*. FIG. 11*b* shows the spectrogram of the mentioned transient like signal with the filter ringing artifact that temporally precedes and succeeds the transient after applying the above described BWE technique without any filter ringing reduction. Each of the horizontal lines represents the filter ringing at the transition frequency between consecutive patches. FIG. 6 shows the same signal after applying the inventive approach within the BWE. Through the application of ringing reduction, the filter ringing is reduced by approx. 20 dB compared to the signal displayed in the previous Figure.

Figure 14A:
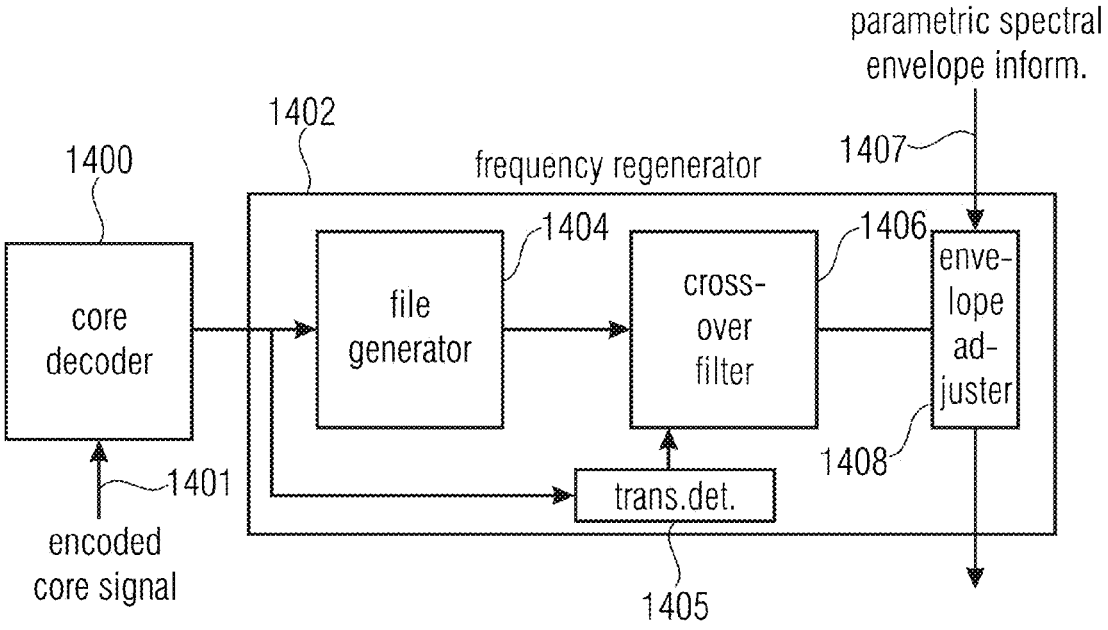
FIG. 14*a* illustrates a further apparatus for decoding an encoded audio signal using a cross-over filter.
Figure 14B:
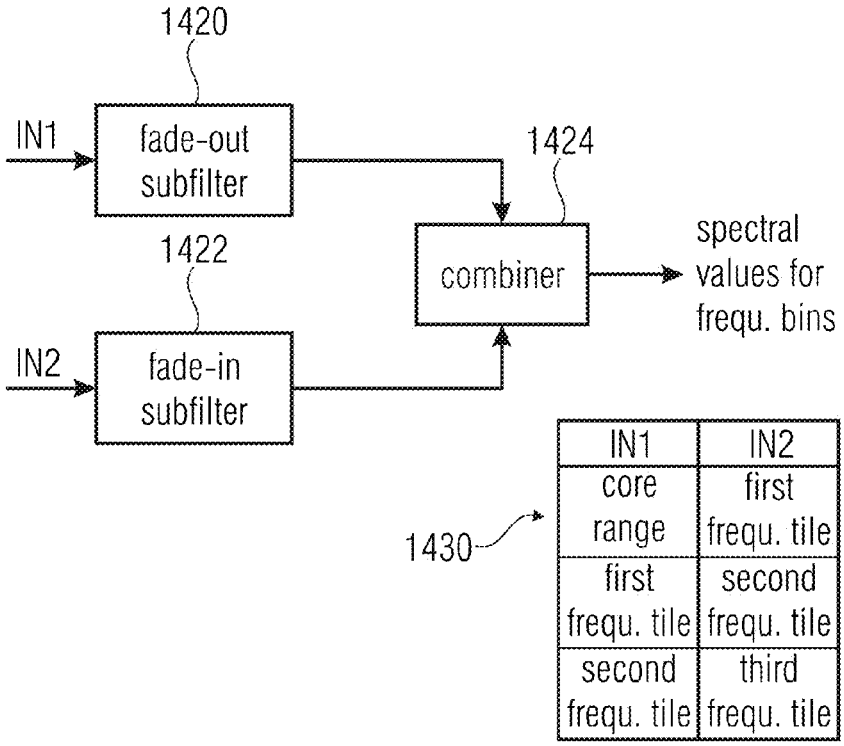
FIG. 14*b* illustrates a more detailed illustration of an exemplary cross-over filter.

Subsequently, FIGS. 14*a*, 14*b* are discussed in order to further illustrate the cross-over filter invention aspect already discussed in the context with the analyzer feature. However, the cross-over filter 710 can also be implemented independent of the invention discussed in the context of FIGS. 6*a*-7*b*.

FIG. 14*a* illustrates an apparatus for decoding an encoded audio signal comprising an encoded core signal and information on parametric data. The apparatus comprises a core decoder 1400 for decoding the encoded core signal to obtain a decoded core signal. The decoded core signal can be bandwidth limited in the context of the FIG. 13*a*, FIG. 13*b* implementation or the core decoder can be a full frequency range or full rate coder in the context of FIG. 1 to 5*c* or 9*a*-10*d*.

Furthermore, a tile generator 1404 for regenerating one or more spectral tiles having frequencies not included in the decoded core signal are generated using a spectral portion of the decoded core signal. The tiles can be reconstructed second spectral portions within a reconstruction band as, for example, illustrated in the context of FIG. 3*a* or which can include first spectral portions to be reconstructed with a high resolution but, alternatively, the spectral tiles can also comprise completely empty frequency bands when the encoder has performed a hard band limitation as illustrated in FIG. 13*a*.

Furthermore, a cross-over filter 1406 is provided for spectrally cross-over filtering the decoded core signal and a first frequency tile having frequencies extending from a gap filling frequency 309 to a first tile stop frequency or for spectrally cross-over filtering a first frequency tile 1225 and a second frequency tile 1221, the second frequency tile having a lower border frequency being frequency-adjacent to an upper border frequency of the first frequency tile 1225.

In a further implementation, the cross-over filter 1406 output signal is fed into an envelope adjuster 1408 which applies parametric spectral envelope information included in an encoded audio signal as parametric side information to finally obtain an envelope-adjusted regenerated signal. Elements 1404, 1406, 1408 can be implemented as a frequency regenerator as, for example, illustrated in FIG. 13*b*, FIG. 1*b* or FIG. 6*a*, for example.

FIG. 14*b* illustrates a further implementation of the cross-over filter 1406. The cross-over filter 1406 comprises a fade-out subfilter receiving a first input signal IN1, and a second fade-in subfilter 1422 receiving a second input IN2 and the results or outputs of both filters 1420 and 1422 are provided to a combiner 1424 which is, for example, an adder. The adder or combiner 1424 outputs the spectral values for the frequency bins. FIG. 12*c* illustrates an example cross-fade function comprising the fade-out subfilter characteristic 1420*a* and the fade-in subfilter characteristic 1422*a*. Both filters have a certain frequency overlap in the example in FIG. 12*c* equal to 21, i.e., N=21. Thus, other frequency values of, for example, the source region 1252 are not influenced. Only the highest 21 frequency bins of the source range 1252 are influenced by the fade-out function 1420*a*.

On the other hand, only the lowest 21 frequency lines of the first frequency tile 1225 are influenced by the fade-in function 1422*a*.

Additionally, it becomes clear from the cross-fade functions that the frequency lines between 9 and 13 are influenced, but the fade-in function actually does not influence the frequency lines between 1 and 9 and face-out function 1420*a* does not influence the frequency lines between 13 and 21. This means that only an overlap might be useful between frequency lines 9 and 13, and the cross-over frequency such as $f_{x1}$ would be placed at frequency sample or frequency bin 11. Thus, only an overlap of two frequency bins or frequency values between the source range and the first frequency tile might be used in order to implement the cross-over or cross-fade function.

Depending on the specific implementation, a higher or lower overlap can be applied and, additionally, other fading functions apart from a cosine function can be used. Furthermore, as illustrated in FIG. 12*c*, it is advantageous to apply a certain notch in the cross-over range. Stated differently, the energy in the border ranges will be reduced due to the fact that both filter functions do not add up to unity as it would be the case in a notch-free cross-fade function. This loss of energy for the borders of the frequency tile, i.e., the first frequency tile will be attenuated at the lower border and at the upper border, the energies concentrated more to the middle of the bands. Due to the fact, however, that the spectral envelope adjustment takes place subsequent to the processing by the cross-over filter, the overall frequency is not touched, but is defined by the spectral envelope data such as the corresponding scale factors as discussed in the context of FIG. 3*a*. In other words, the calculator 918 of FIG. 9*b* would then calculate the "already generated raw target range", which is the output of the cross-over filter. Furthermore, the energy loss due to the removal of a tonal portion by interpolation would also be compensated for due to the fact that this removal then results in a lower tile energy and the gain factor for the complete reconstruction band will become higher. On the other hand, however, the cross-over frequency results in a concentration of energy more to the middle of a frequency tile and this, in the end, effectively reduces the artifacts, particularly caused by transients as discussed in the context of FIGS. 11*a*-11*c*.

FIG. 14*b* illustrates different input combinations. For a filtering at the border between the source frequency range and the frequency tile, input 1 is the upper spectral portion of the core range and input 2 is the lower spectral portion of the first frequency tile or of the single frequency tile, when only a single frequency tile exists. Furthermore, the input can be the first frequency tile and the transition frequency can be the upper frequency border of the first tile and the input into the subfilter 1422 will be the lower portion of the second frequency tile. When an additional third frequency tile exists, then a further transition frequency will be the frequency border between the second frequency tile and the third frequency tile and the input into the fade-out subfilter 1421 will be the upper spectral range of the second frequency tile as determined by filter parameter, when the FIG. 12*c* characteristic is used, and the input into the fade-in subfilter 1422 will be the lower portion of the third frequency tile and, in the example of FIG. 12*c*, the lowest 21 spectral lines.

As illustrated in FIG. 12*c*, it is advantageous to have the parameter N equal for the fade-out subfilter and the fade-in subfilter. This, however, is not necessary. The values for N can vary and the result will then be that the filter "notch" will be asymmetric between the lower and the upper range. Additionally, the fade-in/fade-out functions do not necessarily have to be in the same characteristic as in FIG. 12*c*. Instead, asymmetric characteristics can also be used.

Furthermore, it is advantageous to make the cross-over filter characteristic signal-adaptive. Therefore, based on a signal analysis, the filter characteristic is adapted. Due to the fact that the cross-over filter is particularly useful for transient signals, it is detected whether transient signals occur. When transient signals occur, then a filter characteristic such as illustrated in FIG. 12*c* could be used. When, however, a non-transient signal is detected, it is advantageous to change the filter characteristic to reduce the influence of the cross-over filter. This could, for example, be obtained by setting N to zero or by setting $X_{bias}$ to zero so that the sum of both filters is equal to 1, i.e., there is no notch filter characteristic in the resulting filter. Alternatively, the cross-over filter 1406 could simply be bypassed in case of non-transient signals. Advantageously, however, a relatively slow changing filter characteristic by changing parameters N, $X_{bias}$ is advantageous in order to avoid artifacts obtained by the quickly changing filter characteristics. Furthermore, a low-pass filter is advantageous for only allowing such relatively small filter characteristic changes even though the signal is changing more rapidly as detected by a certain transient/tonality detector. The detector is illustrated at 1405 in FIG. 14*a*. It may receive an input signal into a tile generator or an output signal of the tile generator 1404 or it can even be connected to the core decoder 1400 in order to obtain a transient/non-transient information such as a short block indication from AAC decoding, for example. Naturally, any other crossover filter different from the one shown in FIG. 12*c* can be used as well.

Then, based on the transient detection, or based on a tonality detection or based on any other signal characteristic detection, the cross-over filter 1406 characteristic is changed as discussed.

Although some aspects have been described in the context of an apparatus for encoding or decoding, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a Hard Disk Drive (HDD), a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LIST OF CITATIONS

[1] Dietz, L. Liljeryd, K. Kjörling and O. Kunz, "Spectral Band Replication, a novel approach in audio coding," in 112th AES Convention, Munich, May 2002.

[2] Ferreira, D. Sinha, "Accurate Spectral Replacement", Audio Engineering Society Convention, Barcelona, Spain 2005.

[3] D. Sinha, A. Ferreira1 and E. Harinarayanan, "A Novel Integrated Audio Bandwidth Extension Toolkit (ABET)", Audio Engineering Society Convention, Paris, France 2006.

[4] R. Annadana, E. Harinarayanan, A. Ferreira and D. Sinha, "New Results in Low Bit Rate Speech Coding and Bandwidth Extension", Audio Engineering Society Convention, San Francisco, USA 2006.

[5] T. Żernicki, M. Bartkowiak, "Audio bandwidth extension by frequency scaling of sinusoidal partials", Audio Engineering Society Convention, San Francisco, USA 2008.

[6] J. Herre, D. Schulz, Extending the MPEG-4 AAC Codec by Perceptual Noise Substitution, 104th AES Convention, Amsterdam, 1998, Preprint 4720.

[7] M. Neuendorf, M. Multrus, N. Rettelbach, et al., MPEG Unified Speech and Audio Coding—The ISO/MPEG Standard for High-Efficiency Audio Coding of all Content Types, 132nd AES Convention, Budapest, Hungary, April, 2012.

[8] McAulay, Robert J., Quatieri, Thomas F. "Speech Analysis/Synthesis Based on a Sinusoidal Representation". IEEE Transactions on Acoustics, Speech, And Signal Processing, Vol 34(4), August 1986.

[9] Smith, J. O., Serra, X. "PARSHL: An analysis/synthesis program for non-harmonic sounds based on a sinusoidal representation", Proceedings of the International Computer Music Conference, 1987.

[10] Purnhagen, H.; Meine, Nikolaus, "HILN—the MPEG-4 parametric audio coding tools," *Circuits and Systems,* 2000. *Proceedings. ISCAS* 2000 *Geneva. The* 2000 *IEEE International Symposium on*, vol. 3, no., pp. 201, 204 vol. 3, 2000

[11] International Standard ISO/IEC 13818-3, Generic Coding of Moving Pictures and Associated Audio: Audio", Geneva, 1998.

[12] M. Bosi, K. Brandenburg, S. Quackenbush, L. Fielder, K. Akagiri, H. Fuchs, M. Dietz, J. Herre, G. Davidson, Oikawa: "MPEG-2 Advanced Audio Coding", 101st AES Convention, Los Angeles 1996

[13] J. Herre, "Temporal Noise Shaping, Quantization and Coding methods in Perceptual Audio Coding: A Tutorial introduction", 17th AES International Conference on High Quality Audio Coding, August 1999

[14] J. Herre, "Temporal Noise Shaping, Quantization and Coding methods in Perceptual Audio Coding: A Tutorial introduction", 17th AES International Conference on High Quality Audio Coding, August 1999

[15] International Standard ISO/IEC 23001-3:2010, Unified speech and audio coding Audio, Geneva, 2010.

[16] International Standard ISO/IEC 14496-3:2005, Information technology—Coding of audio-visual objects—Part 3: Audio, Geneva, 2005.

[17] P. Ekstrand, "Bandwidth Extension of Audio Signals by Spectral Band Replication", in Proceedings of 1st IEEE Benelux Workshop on MPCA, Leuven, November 2002

[18] F. Nagel, S. Disch, S. Wilde, A continuous modulated single sideband bandwidth extension, ICASSP International Conference on Acoustics, Speech and Signal Processing, Dallas, Tex. (USA), April 2010

[19] Liljeryd, Lars; Ekstrand, Per; Henn, Fredrik; Kjorling, Kristofer: Spectral translation/folding in the subband domain, U.S. Pat. No. 8,412,365, Apr. 2, 2013.

[20] Daudet, L.; Sandler, M.; "MDCT analysis of sinusoids: exact results and applications to coding artifacts reduction," Speech and Audio Processing, IEEE Transactions on, vol. 12, no. 3, pp. 302-312, May 2004.

The invention claimed is:

1. Apparatus for decoding an encoded audio signal comprising an encoded core signal, comprising:

a core decoder for decoding the encoded core signal to acquire a decoded core signal;

a tile generator for generating one or more spectral tiles comprising frequencies not comprised by the decoded core signal using a spectral portion of the decoded core signal; and a cross-over filter for spectrally cross-over filtering the decoded core signal and a first frequency tile comprising frequencies extending from a gap filling frequency to an upper border frequency or for spectrally cross-over filtering a first frequency tile and a second frequency tile, wherein the cross-over filter is configured to perform a frequency-wise weighted addition of the decoded core signal filtered by a fade-out subfilter and at least a portion of the first frequency tile filtered by a fade-in subfilter within a cross-over range extending over at least three frequency values or to perform a frequency-wise weighted addition of at least a part of a first frequency tile filtered by the fade-out subfilter and at least a part of the second frequency tile filtered by the fade-in subfilter within the cross-over range extending over at least three frequency values, wherein one or more of the core decoder, the tile generator, and the cross-over filter is implemented, at least in part, by one or more hardware elements of the apparatus.

2. Apparatus of claim 1, wherein a spectral portion of the decoded core signal, a spectral portion of the first frequency tile or a spectral portion of the second frequency tile influenced by the cross-over filter is smaller than 30% of the spectral portion covered by a total spectral band of the decoded core signal or a total spectral band of the first or second frequency tiles and is greater than or equal to a band defined by at least 5 adjacent frequency values.

3. Apparatus of claim 1, wherein the cross-over filter is configured for applying a cosine-like filter characteristic for fading-in and fading-out.

4. Apparatus in accordance with claim 1 comprising an envelope adjuster for envelope adjusting a cross-over filtered spectral signal in a spectral range defined by spectral ranges of the one or more spectral tiles using parametric spectral envelope information comprised by the encoded audio signal.

5. Apparatus of claim 1, further comprising a frequency-time converter for converting an envelope-adjusted signal together with the decoded core signal into a time representation.

6. Apparatus in accordance with claim 5, wherein the frequency-time converter is configured for applying an inverse modified discrete cosine transform comprising an overlap/add processing of a current frame with a preceding time frame.

7. Apparatus in accordance with claim 1, wherein the cross-over filter is a controllable filter, wherein the apparatus further comprises a signal characteristics detector, and wherein the signal characteristics detector is configured for controlling a filter characteristic of the cross-over filter in accordance with a detection result derived from the decoded core signal.

8. Apparatus of claim 7, wherein the signal characteristics detector is a transient detector, and wherein the transient detector is configured to control the cross-over filter in such a way that, for a more transient signal portion, the cross-over filter has a first impact on a cross-over filter input signal and that the cross-over filter has a second impact on the cross-over filter input signal for a less-transient signal portion, wherein the first impact is higher than the second impact.

9. Apparatus in accordance with claim 1, wherein a characteristic of the cross-over filter is defined by a fade-out subfilter characteristic and a fade-in subfilter characteristic, wherein the fade-in subfilter characteristic $h_{in}(k)$, and the fade-out subfilter characteristic $h_{out}(k)$ are defined based on the following equations:

$$h_{out}(k) = h_{in}(N-1-k),$$

$$\forall\ Xbias$$

$$h_{out}(k) + h_{in}(k) = 1,$$

$$Xbias = 0$$

$$h_{out}(k) = 0.5 + 0.5 \cdot \cos\left(\frac{k}{N-1-Xbias} \cdot \pi\right),$$

$$k = 0, 1, \ldots, N-1-Xbias,$$

wherein Xbias is an integer defining a slope of both filters extending between zero and an integer N, wherein k is a frequency index extending between zero and N−1, and wherein N is an additional integer, and wherein different values for N and Xbias result in different cross-over filter characteristics.

10. Apparatus of claim 9, wherein Xbias is set between 2 and 20 and wherein N is set between 10 and 50.

11. Apparatus in accordance with claim 1, wherein the tile generator is configured to generate a preliminary frequency tile, wherein an analyzer is configured for analyzing the preliminary frequency tile, wherein the tile generator is additionally configured for generating a regenerated signal comprising attenuated or eliminated tonal portions in relation to the preliminary frequency tile, wherein the tile generator is configured to eliminate or attenuate the tonal portions near frequency tile borders to acquire an input signal into the cross-over filter.

12. Apparatus of claim 11, wherein the tile generator is configured to detect and remove or attenuate tonal spectral portions within a detection range being less than 20% of a bandwidth of a frequency tile or a source range for the regeneration.

13. Apparatus of claim 1, wherein the cross-over filter is configured to cross-over filter within an overlapping range, the overlapping range comprising an upper frequency portion of the decoded core signal and a lower frequency portion of the first frequency tile, or wherein the cross-over filter is configured to cross-over filter within an overlapping range, the overlapping range comprising an upper frequency portion of a first frequency tile and a lower frequency portion of a second frequency tile.

14. Method of decoding an encoded audio signal comprising an encoded core signal, comprising:

decoding the encoded core signal to acquire a decoded core signal;

generating one or more spectral tiles comprising frequencies not comprised by the decoded core signal using a spectral portion of the decoded core signal; and spectrally cross-over filtering, using a cross-over filter, the decoded core signal and a first frequency tile comprising frequencies extending from a gap filling frequency to an upper border frequency or for spectrally cross-over filtering a first frequency tile and a second frequency tile, wherein the cross-over filter is configured to perform a frequency-wise weighted addition of the decoded core signal filtered by a fade-out subfilter and at least a portion of the first frequency tile filtered by a fade-in subfilter within a cross-over range extending over at least three frequency values or to perform a frequency-wise weighted addition of at least a part of a first frequency tile filtered by the fade-out subfilter and at least a part of the second frequency tile filtered by the fade-in subfilter within the cross-over range extending over at least three frequency values, wherein one or more of decoding, generating, and spectrally cross-over filtering is implemented, at least in part, by one or more hardware elements of an audio signal processing device.

15. Non-transitory digital storage medium for performing, when running on a computer or a processor, a method of decoding an encoded audio signal comprising an encoded core signal, the method comprising:

decoding the encoded core signal to acquire a decoded core signal;

generating one or more spectral tiles comprising frequencies not comprised by the decoded core signal using a spectral portion of the decoded core signal; and spectrally cross-over filtering, using a cross-over filter, the decoded core signal and a first frequency tile comprising frequencies extending from a gap filling frequency to an upper border frequency or for spectrally cross-over filtering a first frequency tile and a second frequency tile, wherein the cross-over filter is configured to perform a frequency-wise weighted addition of the decoded core signal filtered by a fade-out subfilter and at least a portion of the first frequency tile filtered by a fade-in subfilter within a cross-over range extending over at least three frequency values or to perform a frequency-wise weighted addition of at least a part of a first frequency tile filtered by the fade-out subfilter and at least a part of the second frequency tile filtered by the fade-in subfilter within the cross-over range extending over at least three frequency values.

* * * * *